US007874191B2

(12) United States Patent
Chiang et al.

(10) Patent No.: US 7,874,191 B2
(45) Date of Patent: Jan. 25, 2011

(54) CYLINDER LOCK

(75) Inventors: Wei-Liang Chiang, Chiayi (TW); Ju-Lin Yang, Chiayi County (TW); Po-Yang Chen, Chiayi (TW); Kun-Chen Lee, Chiayi County (TW); Rong-Faa Wu, Chiayi (TW); Ching Chuan Kuo, Chiayi County (TW)

(73) Assignee: Tong Lung Metal Industry Co., Ltd., Chia-Yi (TW)

( * ) Notice: Subject to any disclaimer, the term of this patent is extended or adjusted under 35 U.S.C. 154(b) by 483 days.

(21) Appl. No.: 11/972,961

(22) Filed: Jan. 11, 2008

(65) Prior Publication Data

US 2008/0264127 A1 Oct. 30, 2008

(30) Foreign Application Priority Data

Apr. 24, 2007 (TW) ..... 96114532 A

(51) Int. Cl.
*E05B 27/04* (2006.01)
*E05B 29/04* (2006.01)

(52) U.S. Cl. ..... 70/492; 70/383; 70/384; 70/493; 70/495

(58) Field of Classification Search ..... 70/337–343, 70/368, 382–385, 491–493, 495
See application file for complete search history.

(56) References Cited

U.S. PATENT DOCUMENTS

| | | | | |
|---|---|---|---|---|
| 4,372,139 | A * | 2/1983 | Laake | 70/383 |
| 4,850,210 | A * | 7/1989 | Adler et al. | 70/383 |
| 4,912,953 | A * | 4/1990 | Wobig | 70/383 |
| 4,942,749 | A * | 7/1990 | Rabinow | 70/495 |
| 5,211,044 | A * | 5/1993 | Kim | 70/371 |
| 5,233,850 | A * | 8/1993 | Schroeder | 70/337 |
| 5,325,690 | A * | 7/1994 | Adler et al. | 70/383 |
| 6,860,131 | B2 | 3/2005 | Armstrong et al. | |
| 6,959,569 | B2 | 11/2005 | Strader et al. | |
| 7,007,528 | B2 | 3/2006 | Chong et al. | |
| 7,047,778 | B2 | 5/2006 | Dimig et al. | |
| 7,213,429 | B2 | 5/2007 | Armstrong et al. | |
| 7,234,331 | B2 | 6/2007 | Armstrong et al. | |
| 7,434,431 | B2 | 10/2008 | Armstrong et al. | |

* cited by examiner

*Primary Examiner*—Suzanne D Barrett
*Assistant Examiner*—Christopher Boswell
(74) *Attorney, Agent, or Firm*—Ladas & Parry LLP

(57) ABSTRACT

A cylinder lock includes a lock housing receiving a plug assembly that has a key hole, tumbler pieces having respective toothed parts, and a re-keying unit. The re-keying unit has rotatable gear wheels engaged releasably with the respective toothed parts to reposition the respective tumbler pieces. The gear wheels disengage from the respective tooth parts by moving transversely of a longitudinal axis of the lock housing. Re-keying methods are also disclosed.

32 Claims, 30 Drawing Sheets

CYLINDER LOCK

CROSS-REFERENCE TO RELATED APPLICATION

This application claims priority of Taiwanese Invention Patent Application No. 096114532 filed on Apr. 24, 2007.

BACKGROUND OF THE INVENTION

1. Field of the Invention

This application relates to a cylinder lock, more particularly to a re-keyable cylinder lock and a method of re-keying the re-keyable cylinder lock.

2. Description of the Related Art

Traditionally, when it is necessary to re-key a lock mounted on a door, the lock is detached from the door to disassemble a plug from the lock and to exchange tumbler pins of the plug so as to match a new key. After exchange of the tumbler pins, the lock is re-assembled and re-installed on the door. However, disassembly and re-assembly of the lock and exchange of the tumbler pins require a certain level of skill and knowledge with respect to the construction of the lock, and are usually done by a locksmith or a skilled worker with the use of special tools. The traditional method of re-keying is therefore inconvenient.

SUMMARY OF THE INVENTION

An object of the invention is to provide a novel cylinder lock that has a tumbler piece engaged releasably with a gear wheel.

According to one aspect of the invention, a re-keyable cylinder lock comprises: a lock housing having a plug hole with a longitudinal axis; a plug disposed rotatably within the plug hole and including a key hole, and a tumbler piece having a toothed part; and a re-keying unit that has a gear wheel engaged releasably with the toothed part to reposition the tumbler piece.

According to another aspect of the invention, a cylinder lock comprises: a lock housing having a plug hole with a longitudinal axis; a plug disposed rotatably within the plug hole and including a tumbler piece having a toothed part; and a re-keying unit that has a gear wheel engaged releasably with the toothed part to reposition the tumbler piece. The gear wheel is rotatable about an axis parallel to the longitudinal axis.

According to further aspect of the invention, a method of re-keying a cylinder lock comprises: providing the cylinder lock with a plug that has a tumbler piece, a re-keying unit that engages releasably the tumbler piece, and a control bar; inserting a first key into the plug while the plug is in its home position; and moving the control bar from a first position to a second position to cause the re-keying unit to disengage from the tumbler piece while the plug is in its home position.

According to still further aspect of the invention, a method of re-keying a cylinder lock comprises providing the cylinder lock with a plug that has a tumbler piece, a re-keying unit that has a gear wheel engaging the tumbler piece, and a control bar. The re-keying unit is movable transversely of a longitudinal axis of the lock housing so as to disengage the gear wheel from the tumbler piece. The method further comprises: inserting a first key into the plug; and moving the control bar from a first position to a second position to control the gear wheel to move transversely of the longitudinal axis and away from the tumbler piece.

According to still further aspect of the present invention, a method of re-keying a cylinder lock, comprises providing the cylinder lock with a plug that has a tumbler piece, and a re-keying unit that has a gear wheel engaging the tumbler piece, the re-keying unit being fitted in a groove formed in the plug. The method further comprises removing the re-keying unit from the groove of the plug to disengage the gear wheel from the tumbler piece; inserting a right key into the plug to change the orientation of the tumbler piece; and re-inserting the re-keying unit into the groove of the plug to re-engage the gear wheel with the tumbler piece.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
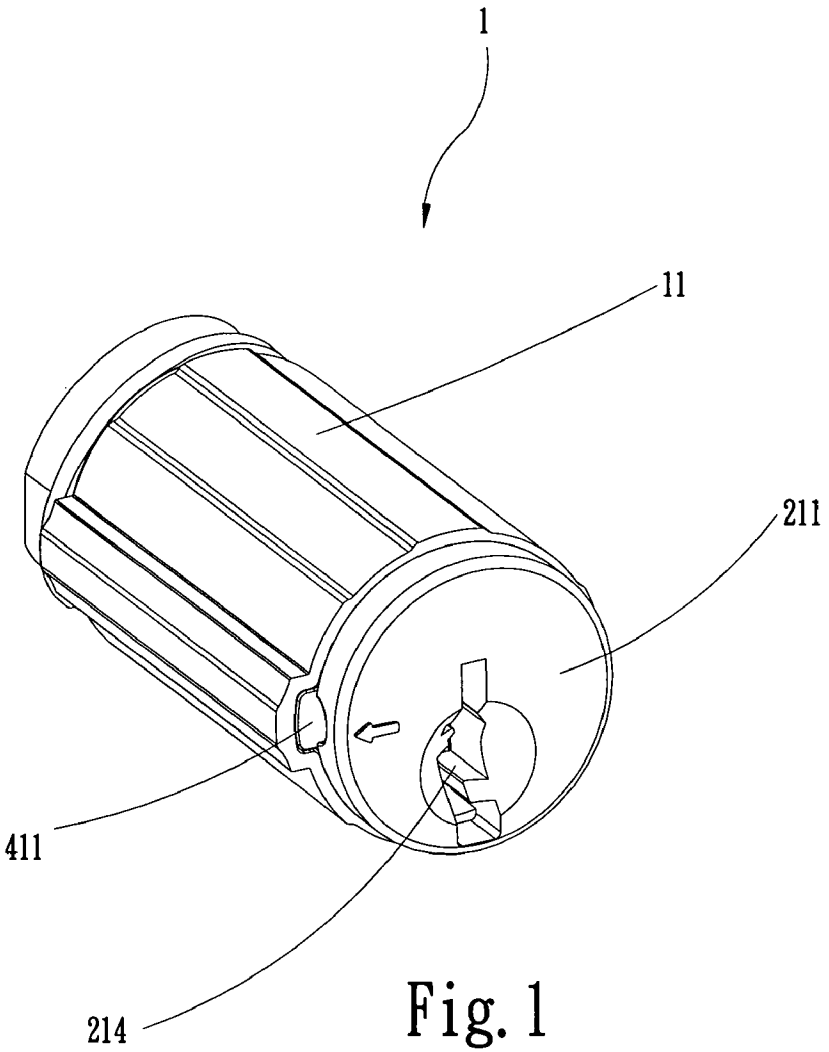
FIG. 1 is a perspective view of a re-keyable cylinder lock according to a preferred embodiment of the present invention.

Before the present invention is described in greater detail, it should be noted that same reference numerals have been used to denote like elements throughout the specification.

Referring to FIGS. 1, 2, 2*a* and 3, there is shown a re-keyable cylinder lock 1 according to a preferred embodiment of the present invention which comprises a lock housing 11 and a plug assembly 2.

The lock housing 11 has a cylindrical wall 113 with first and second ends 111 and 112. The cylindrical wall 113 defines an axial plug hole 120, and a cavity 119 disposed in juxtaposition to the plug hole 120 and extending longitudinally from the first end 111 to a recess 118 (see FIGS. 1 and 2*a*) located at the second end 112. The cavity 119 opens at the first end ill, and is composed of a first cavity section 117 and a second cavity section 116. The first cavity section 117 is smaller in width than the second cavity section 116.

The plug assembly 2 includes a plug 21, and a re-keying unit 3. A control unit is provided to control the re-keying unit 3 and includes a control bar 41 disposed in the cavity 119.

Figure 2:
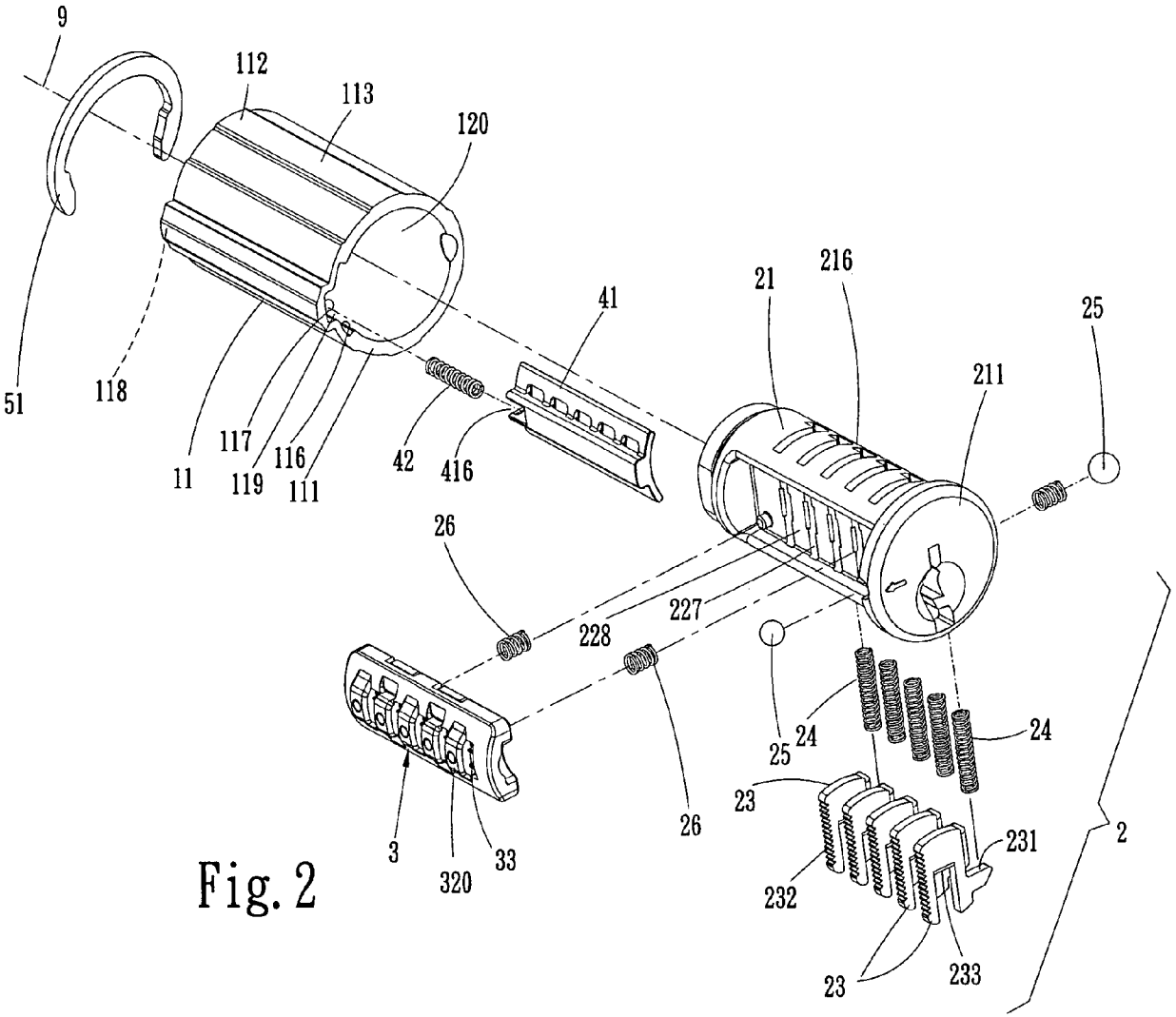
FIG. 2 is an exploded view of the re-keyable cylinder lock.
Figure 2A:
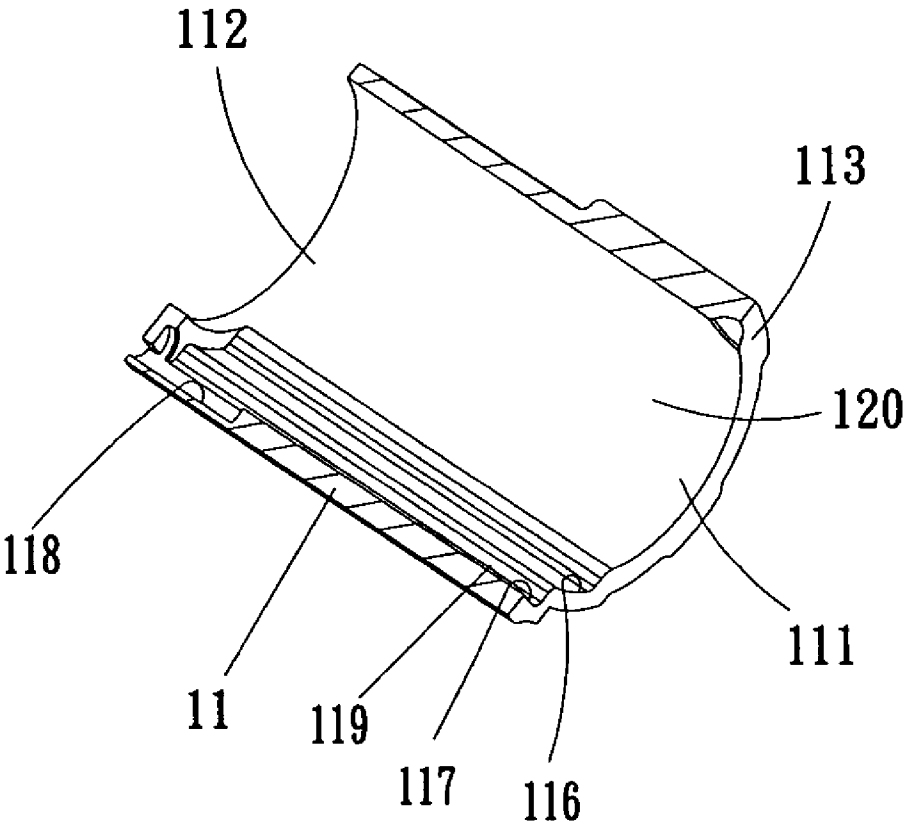
FIG. 2*a* is a fragmentary sectional view of a lock housing of the re-keyable cylinder lock.
Figure 4A:
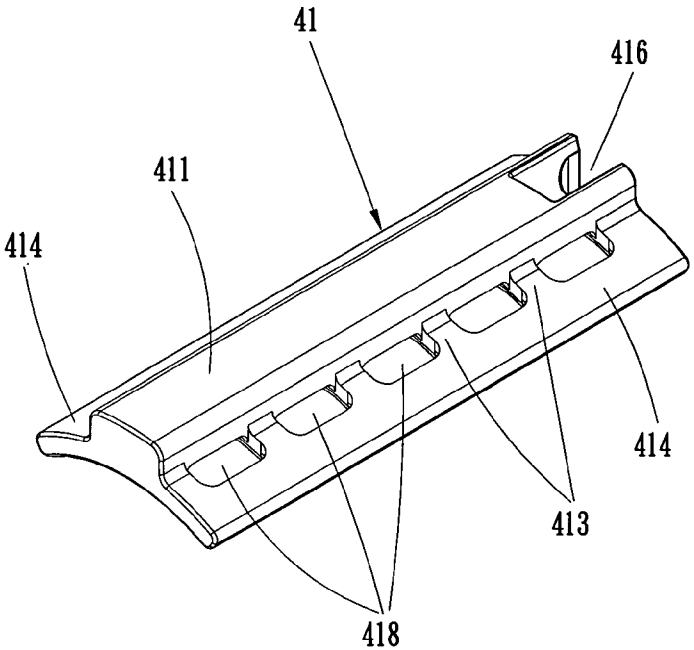
FIG. 4*a* is another perspective view of the control bar.
Figure 4:
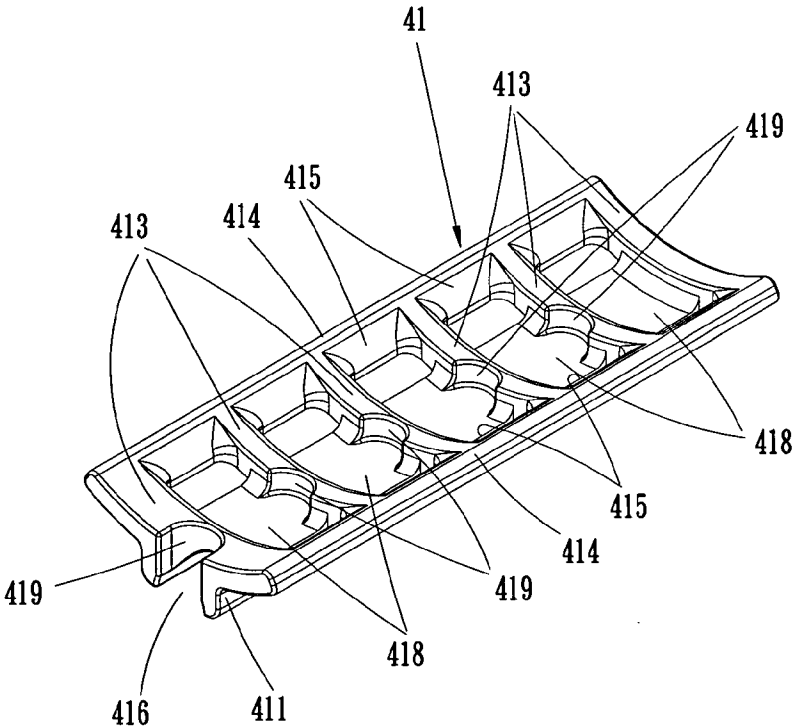
FIG. 4 is a perspective view of a control bar of the re-keyable cylinder lock.

Referring to FIGS. 4 and 4*a* in combination with FIG. 2, the control bar 41 includes a spine portion 411 extending axially in the first cavity section 117, a plurality of transverse ribs 413 connected transversely to the spine portion 411 and received transversely in the second cavity section 116, and two axial ribs 414 received in the second cavity section 116. Each of the transverse ribs 413 has two opposite ends respectively connected to the axial ribs 414. Each axial rib 414 has an inclined face 415. The transverse and axial ribs 413, 414 and the spine portion 411 cooperatively define a plurality of indentations 418. An intermediate part of each transverse rib 413 is recessed to form a detent slot 419 in communication with the respective indentation 418.

The control bar 41 further includes a spring bore 416 formed in the rear end of the spine portion 411 and receiving a biasing spring 42. The control bar 41 is exposed at the first end 111 (see FIGS. 1 and 2) of the lock housing 11 and can be moved against the action of the biasing spring 42 parallel to a longitudinal axis 9 of the lock housing 11.

Figure 3:
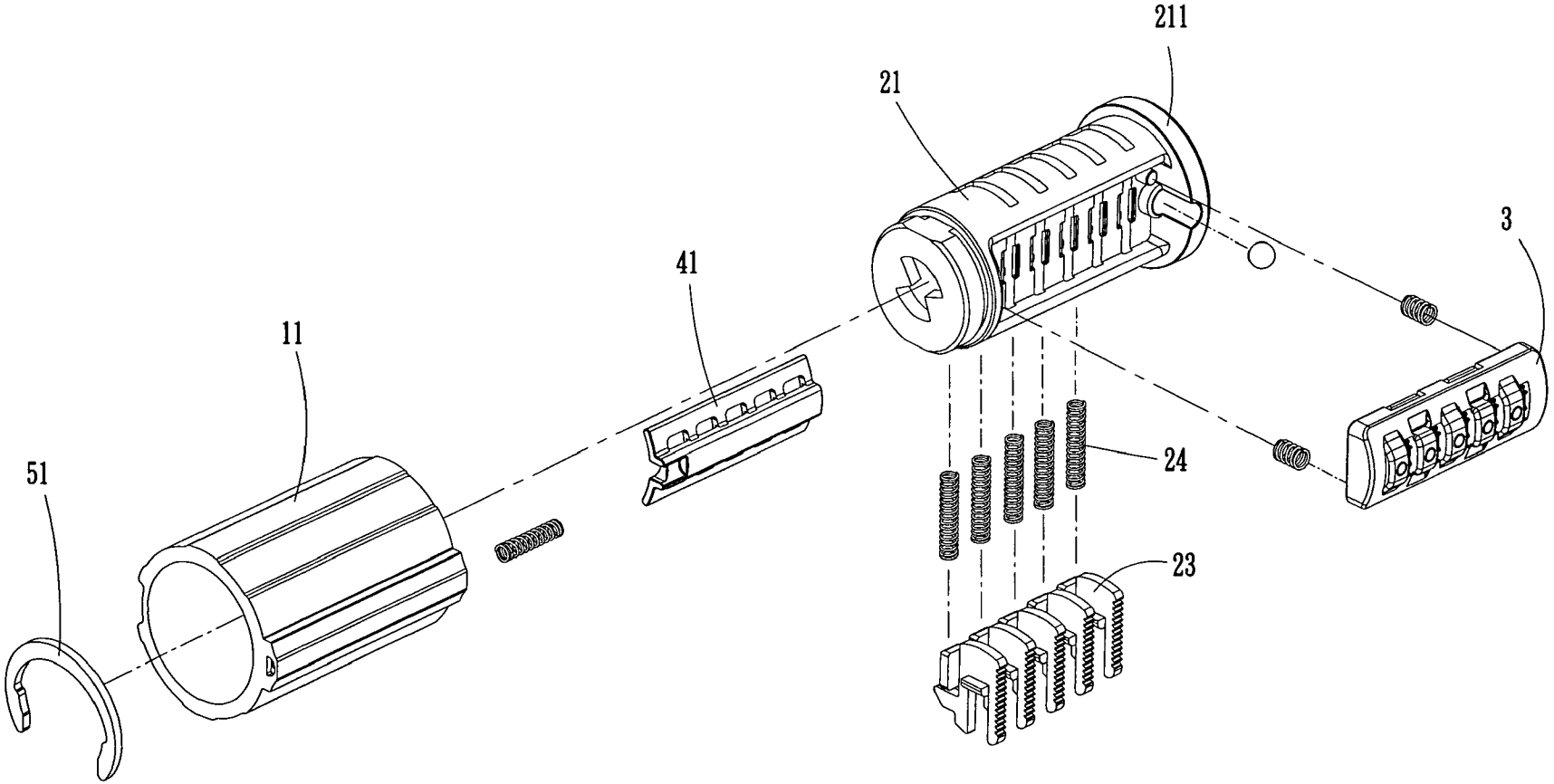
FIG. 3 is another exploded view of the re-keyable cylinder lock.
Figure 5:
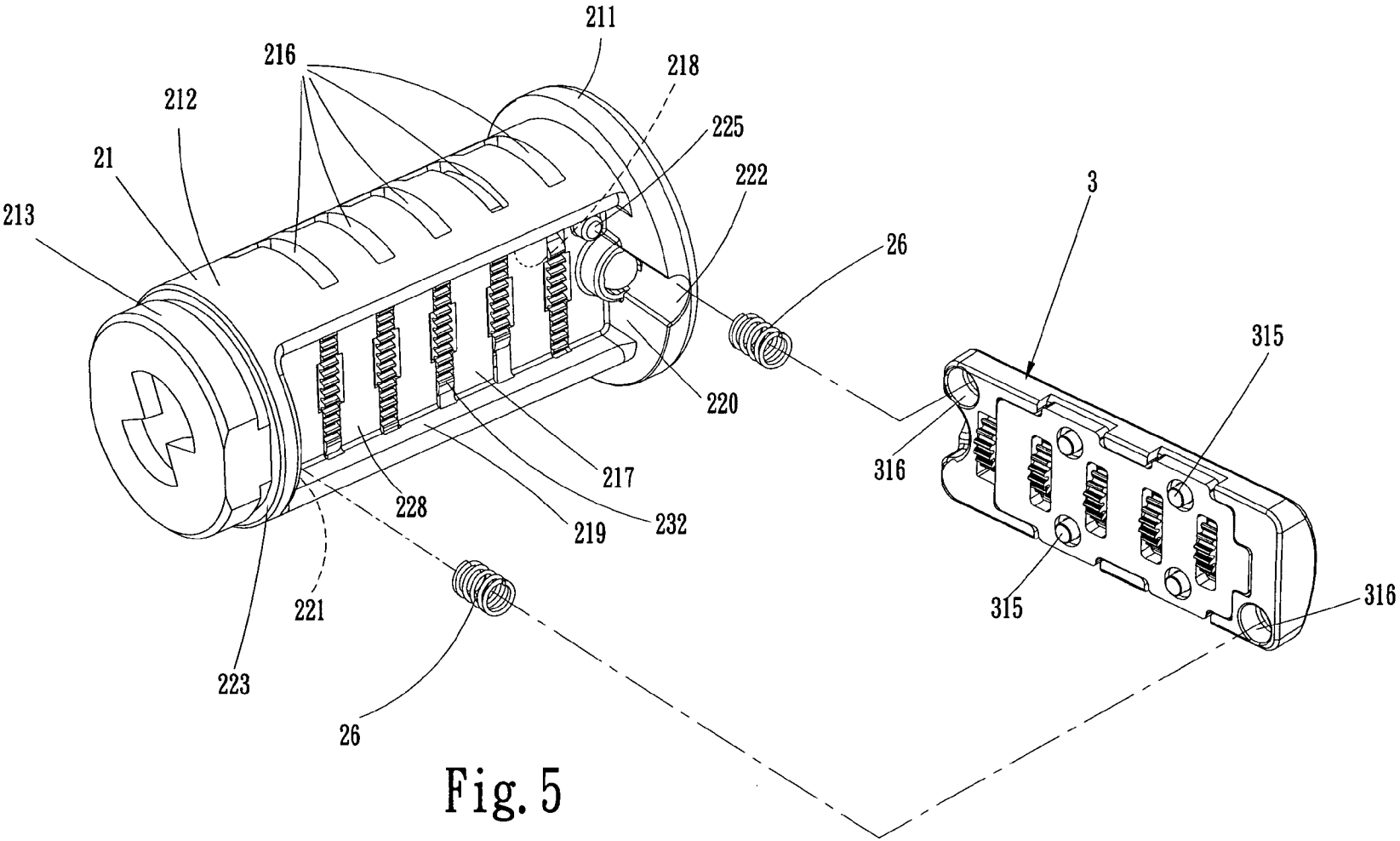
FIG. 5 is an exploded view of a plug assembly of the re-keyable cylinder lock.
Figure 6A:
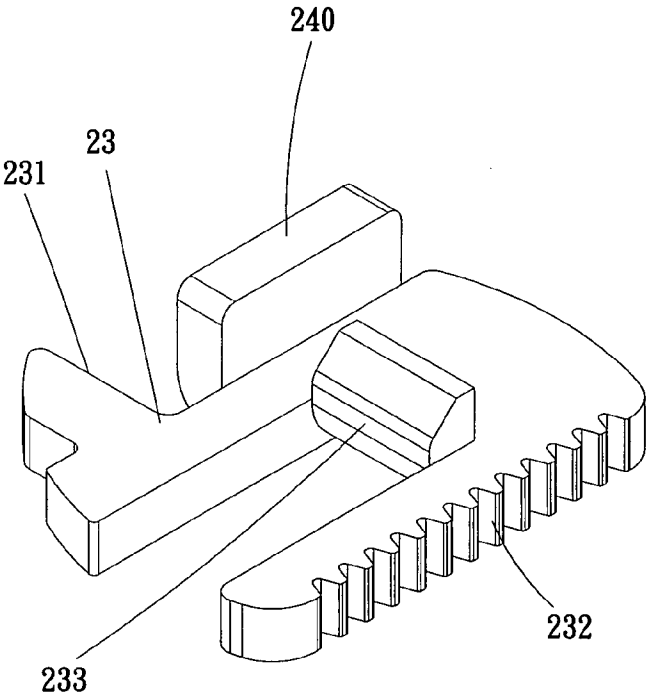
FIG. 6*a* is a perspective view of a tumbler piece of the re-keyable cylinder lock.
Figure 6:
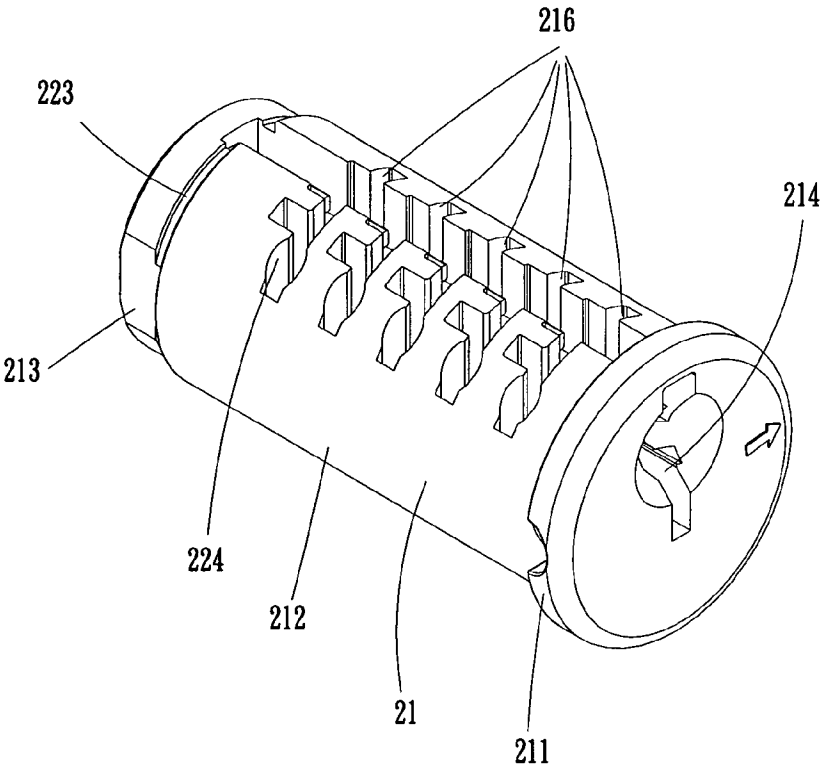
FIG. 6 is a perspective view of a plug of the plug assembly.
Figure 10:
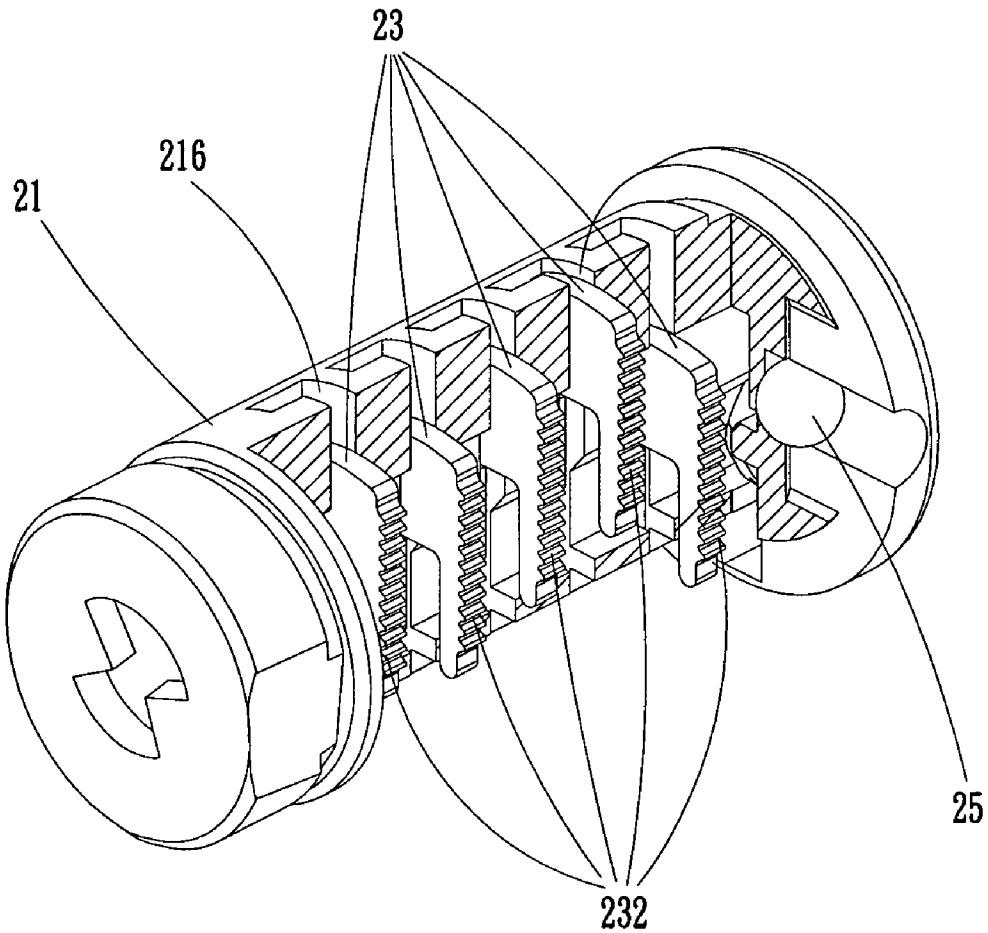
FIG. 10 is a partially sectioned view of the plug.

Referring to FIGS. 5, 6, 10 in combination with FIG. 2, the plug 21 has first, second and third plug sections 211, 212 and 213. A key hole 214 (see FIG. 1) extends through the first, second and third plug sections 211, 212 and 213. The first plug section 211 has a pair of radial slots 222 (only one is shown) respectively receiving anti-drilling balls 25. The third plug section 213 is to be connected drivingly to an actuating rod (not shown), and has an annular groove 223 that receives a retaining ring 51 (FIG. 3). When the plug 21 is inserted into the axial plug hole 120 of the lock housing 11, it is retained rotatably within the plug hole 120 by the retaining ring 51.

The second plug section 212 has a plurality of spaced apart spring holes 224 respectively receiving tumbler springs 24, and a plurality of spaced apart tumbler holes 216 respectively receiving tumbler pieces 23. Each spring hole 224 is communicated with one of the tumbler holes 216. The second plug section 212 is substantially cylindrical and has one side thereof grooved to form a groove 228 which is confined by a groove bottom face 217 and four groove walls 218, 219, 220 and 221. The tumbler holes 216 open at the groove bottom face 217. Two spring retainers 225 (only one is shown) protrude from the groove bottom face 217, and separation springs 26 are disposed around the spring retainers 225, respectively.

Referring to FIG. 6*a* in combination with FIGS. 2 and 10, the tumbler pieces 23 are flat pieces which are respectively received in the tumbler holes 216. Each tumbler piece 23 has a spring-bearing part 231 to abut against the respective tumbler spring 24, a toothed part 232, a key-contacting part 233, and a projection 240.

Figure 7:
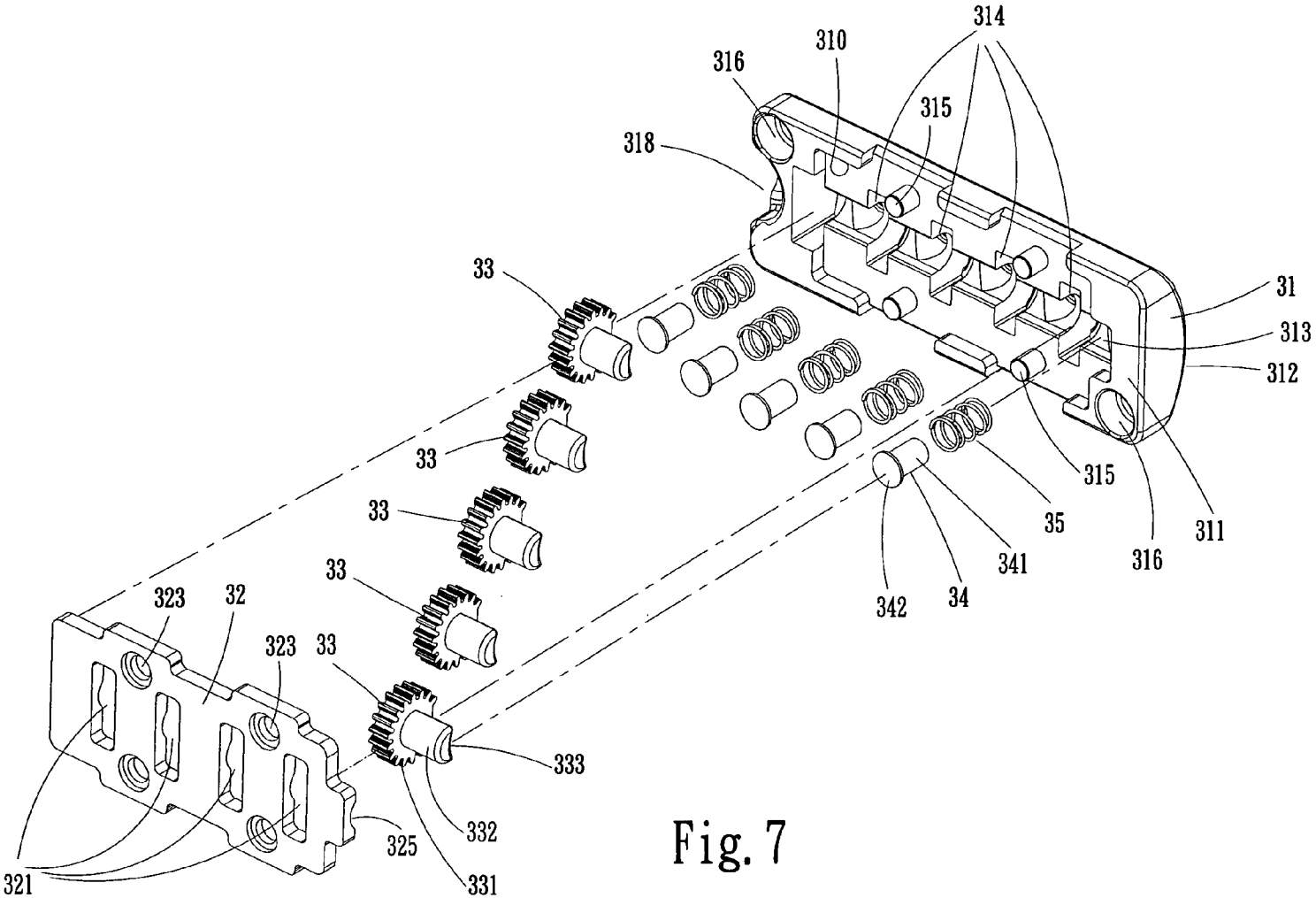
FIG. 7 is an exploded view of a gear holder and a cover plate of the plug assembly.
Figure 9:
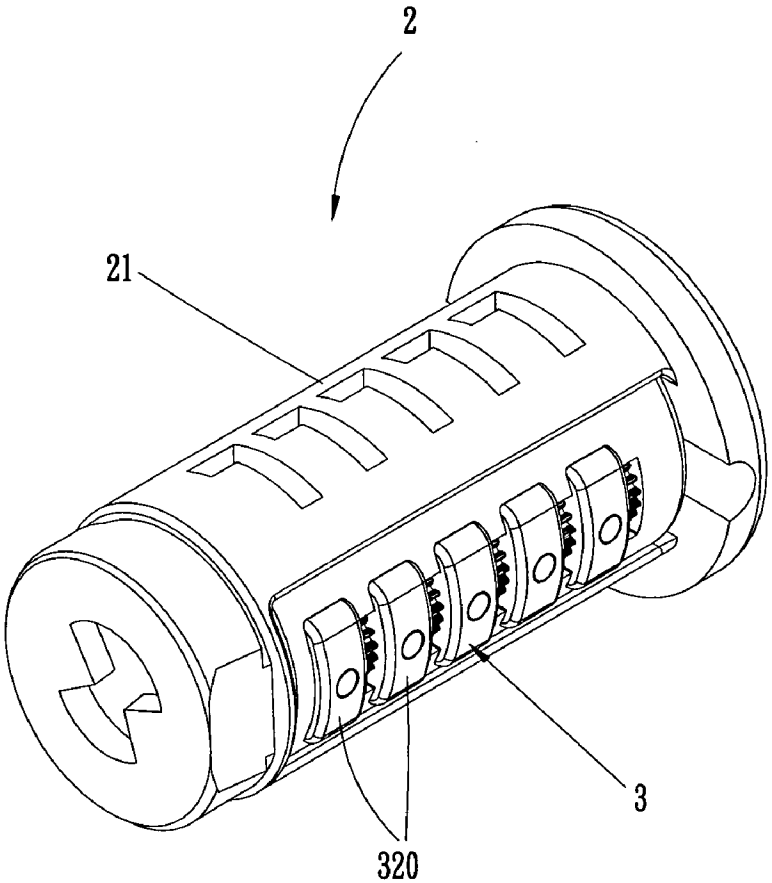
FIG. 9 is a perspective view of the plug assembly.
Figure 8:
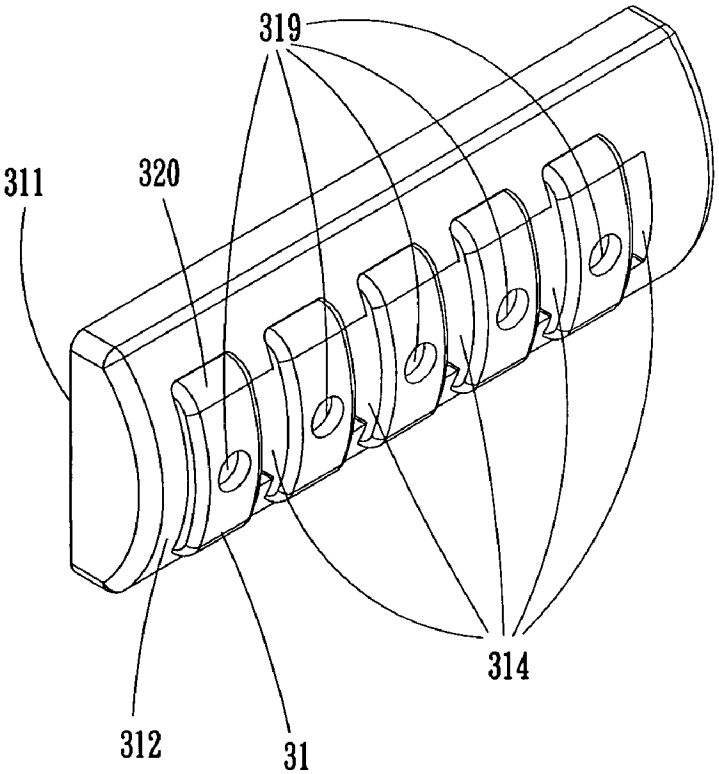
FIG. 8 is a perspective view of the gear holder.

Referring to FIGS. 7 to 9 in combination with FIG. 5, the re-keying unit 3 is disposed in the groove 228 of the plug 21 and complements the plug 21 so as to form a cylinder. The re-keying unit 3 includes a gear holder 31, a cover plate 32, and a plurality of gear wheels 33, a plurality of detent elements 34 and detent springs 35. The gear holder 31 has a curve surface 312 and a flat surface 311. A plurality of protrusions 320 project from the curved surface 312, and a longitudinal slot 313 and transverse slots 314 are formed in the flat surface 311. The protrusions 320 are respectively provided with stepped holes 319 each of which extends inwardly from a curved outer surface of the respective protrusion 320 to the longitudinal slot 313. The curved outer surfaces of the protrusions 320 are substantially flush with the cylindrical outer surface of the plug 21 when the gear wheels 33 engage the respective tumbler pieces 23.

Each detent element 34 is formed as a headed rod and has a stem 341 which is sized and shaped in such a manner that the stem 341 can engage the respective detent slot 419 formed in the control bar 41, and a head 342 which is sized and shaped in such a manner that the head 342 can retain the respective detent spring 35. The stem 341 and the head 342 of each detent element 34 are respectively received in the respective stepped hole 319. Each detent spring 35 is sleeved onto the stem 341 of the respective detent element 24.

Each gear wheel 33 has radial gear teeth 331 engaging releasably the toothed part 232 of the respective tumbler piece 23, and an integral cam portion 332 projecting axially from a central part of the gear wheel 33. Each gear wheel 33 is received in the respective transverse slot 314, and each cam portion 332 is received in the longitudinal slot 313. The gear wheels are rotatable in response to movements of the tumbler pieces 23 upon insertion of a key into the plug 21. Each cam portion 332 has an indented face 333 and is rotatable along with the respective gear wheel 33 to control the respective detent element 34 to engage or disengage from the respective detent slot 419. When the heads 342 of the detent elements 34 contact the respective indented faces 333 of the cam portions 33, the detent elements 34 disengage from the respective detent slots 419.

The gear holder 31 further has two springs holes 316 formed in the flat face 311, four fixing pins 315, a semi-circular slot 318 to receive one of the anti-drilling balls 25, and a recess 310 to receive the cover plate 32. The cover plate 32 has a plurality of transverse holes 321, and four pin holes 323. The transverse holes 321 permit the respective gear wheels 33 to extend therethrough for engagement with the respective tumbler pieces 23 disposed in the plug 21. The pin holes 323 are provided for insertion of the respective fixing pins 315. The cover plate 32 further has a longitudinal recess 325 receiving portions of the cam portions 332.

Figure 11:
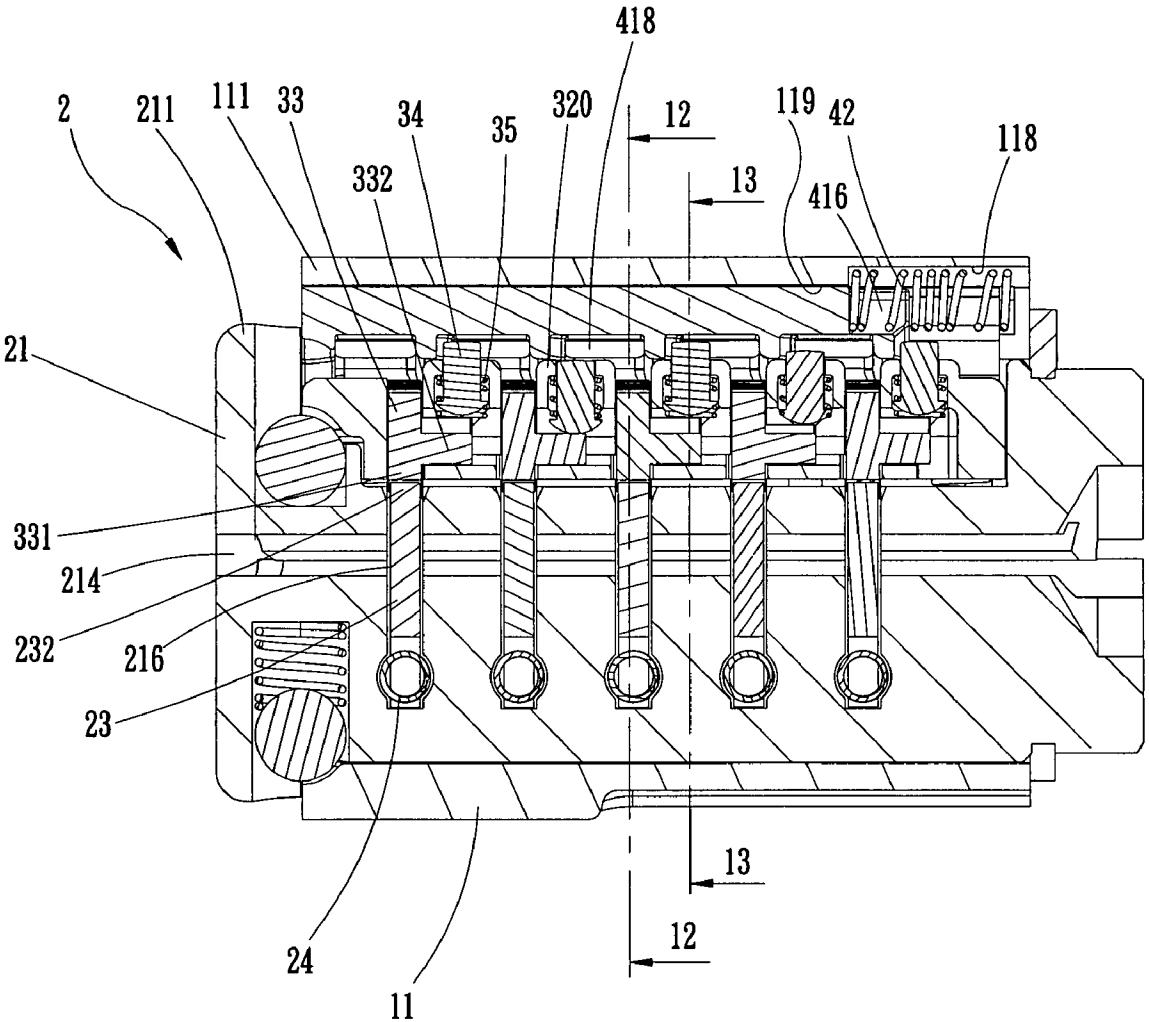
FIGS. 11-13 show the plug assembly in a home position.

Referring to FIG. 11 in combination with FIGS. 1 and 2, the control bar 41 is assembled in the cavity 119 with a front end thereof being exposed from the first end 111 of the lock housing 11. The first plug section 211 of the plug 21 does not cover the front end of the spine portion 411 of the control bar 41. The spring 42 is placed within the recess 118 of the lock housing 11 and the spring bore 416 of the control bar 41 to bias the control bar 41. The tumbler pieces 23 and the tumbler springs 24 are respectively assembled in the tumbler holes 216 and the spring holes 224. Each tumbler spring 24 abuts against the spring-bearing part 231 of the respective tumbler piece 23. The toothed part 232 of each tumbler piece 23 projects from an opening 227 (FIG. 2) of the respective tumbler hole 216.

Referring back to FIGS. 5 and 7, the detent springs 35 are sleeved onto the respective stems 341 of the detent elements 34, and each detent element 34 is placed within the respective stepped hole 319. The gear wheels 33 are disposed in the respective transverse holes 314, and the cam portions 332 are disposed in the longitudinal hole 313. The cam portions 332 are placed in abutment with the respective detent elements 34. The cover plate 32 and the gear holder 31 are fixed together when the fixing pins 315 extending through the respective pin holes 323 are pressed to form expanded ends. The separation springs 26 are assembled on the respective spring retainers 225 of the plug 21 and in the respective spring holes 316 of the gear holder 31. The gear holder 31 assembled with the cover plate 32 is placed in the groove 228 of the plug 21 so that the gear wheels 33 are engaged with the toothed parts 232 of the respective tumbler pieces 23, thereby forming the plug assembly 2. The plug assembly 2 is placed within the lock housing 11 in such a manner that the detent elements 34 are aligned with the respective detent slots 419 (see FIG. 4) formed in the control bar 41.

Figure 13:
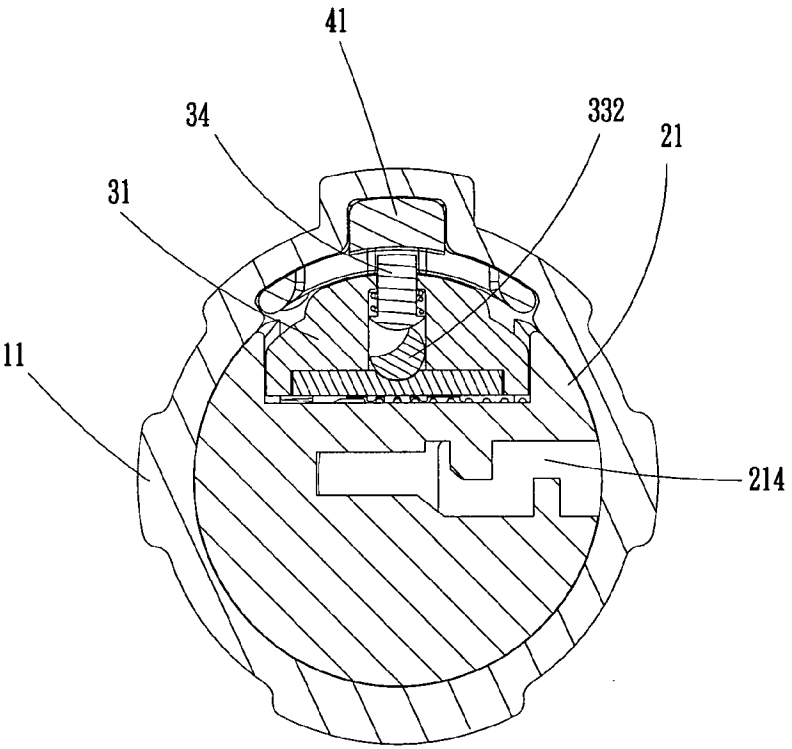
Figure 12:
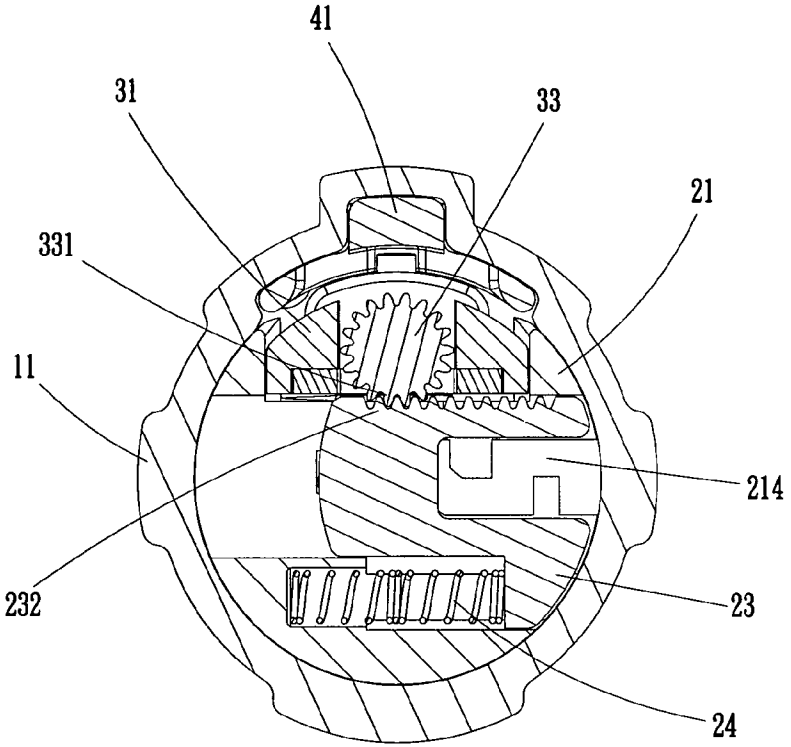

Referring to FIGS. 11-13, the plug assembly 2 is in its home position. When no key is inserted into the plug 21, the tumbler pieces 23 are moved to bottom ends of the respective tumbler holes 216 by the action of the tumbler springs 24, and the gear wheels 33, which are engaged with the respective tumbler pieces 23, are rotated to a position in which the cam portions 332 cam the respective detent elements 34 to project into the respective detent slots 419 through the respective stepped holes 319. Therefore, the plug assembly 2 is limited from rotation relative to the lock housing 11.

Figure 14:
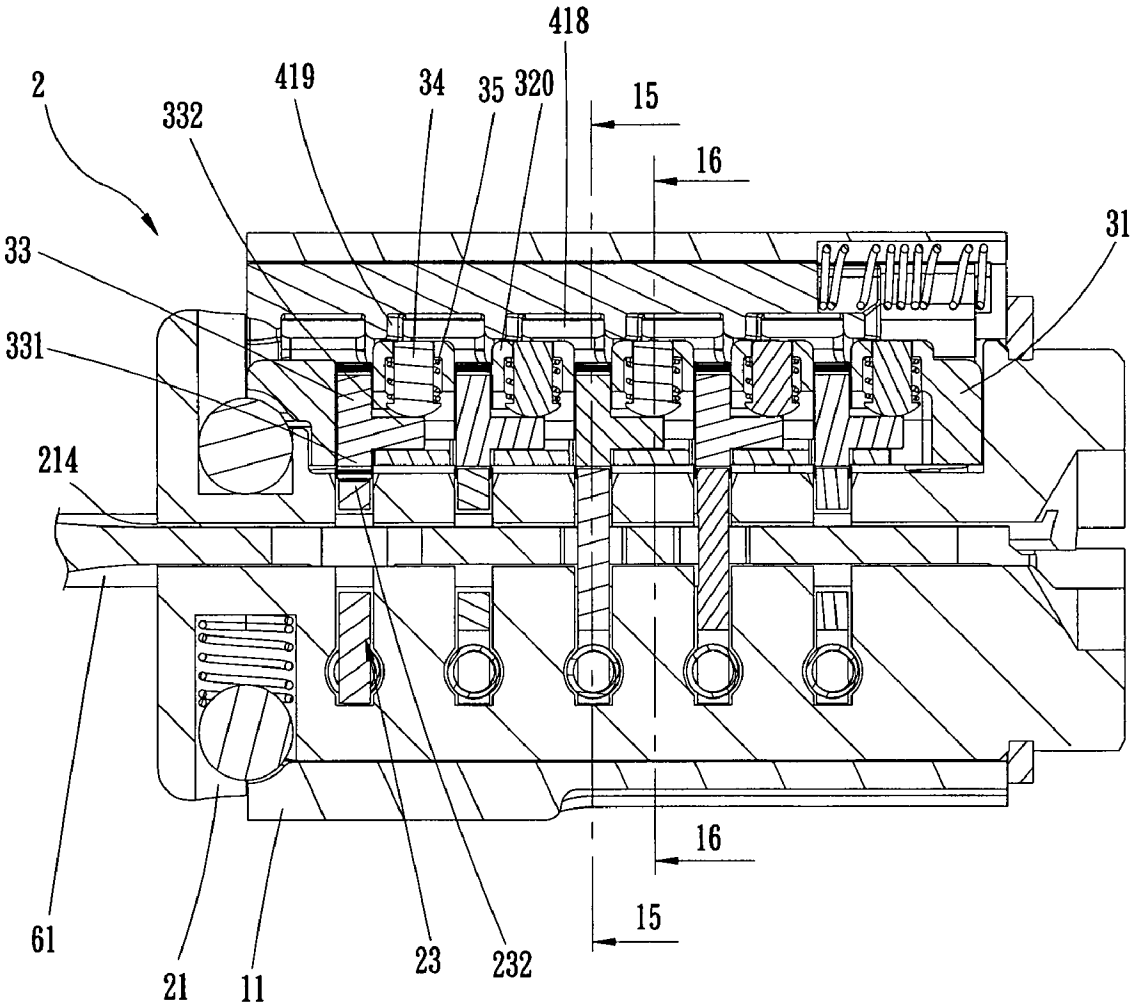
FIGS. 14-16 show the plug assembly with a first key inserted therein.
Figure 16:
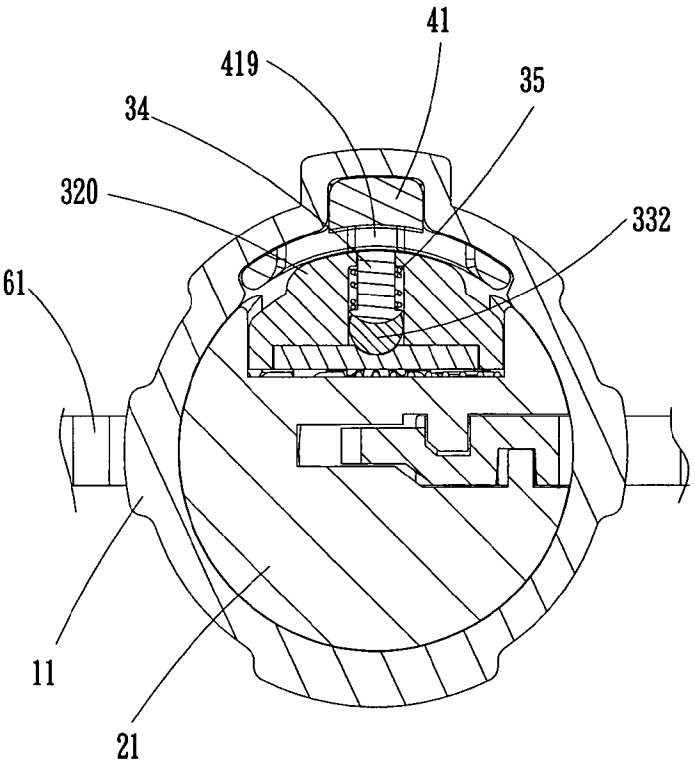
Figure 15:
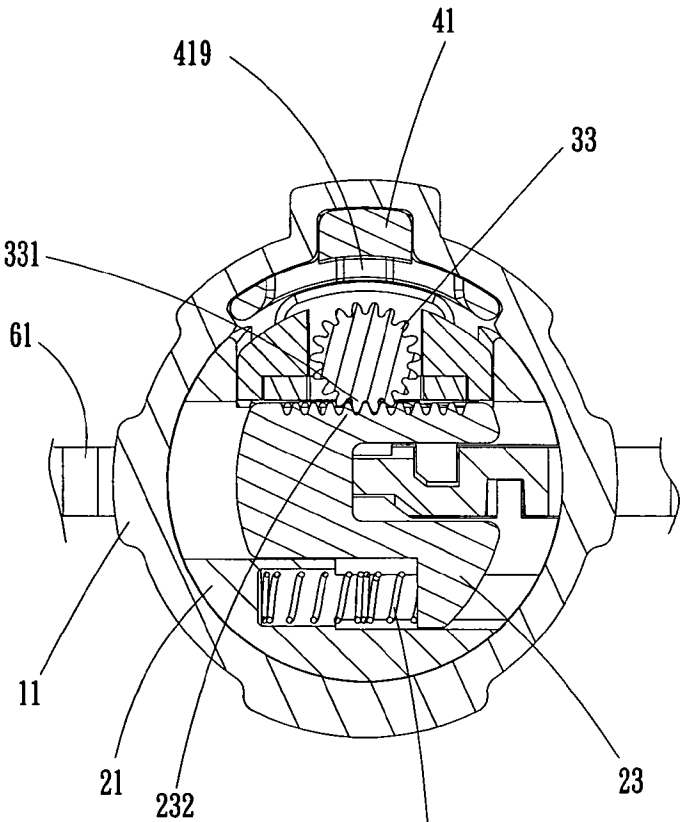

Referring to FIGS. 14-16, when a first key 61 is inserted into the plug assembly 2 in the home position, the tumbler pieces 23 are moved against the tumbler springs 24 by the first key 61 so that the toothed parts 232 thereof rotate the respective gear wheels 33 and cam portions 332. At this state, the indented faces 333 of the cam portions 332 contact the respective heads 342 of the detent elements 34 so that the detent elements 34 move away from the respective detent slots 419 by the action of the detent springs 35. That is to say, the detent elements 34 retract into the plug assembly 2 from the detent slots 419.

Figure 17:
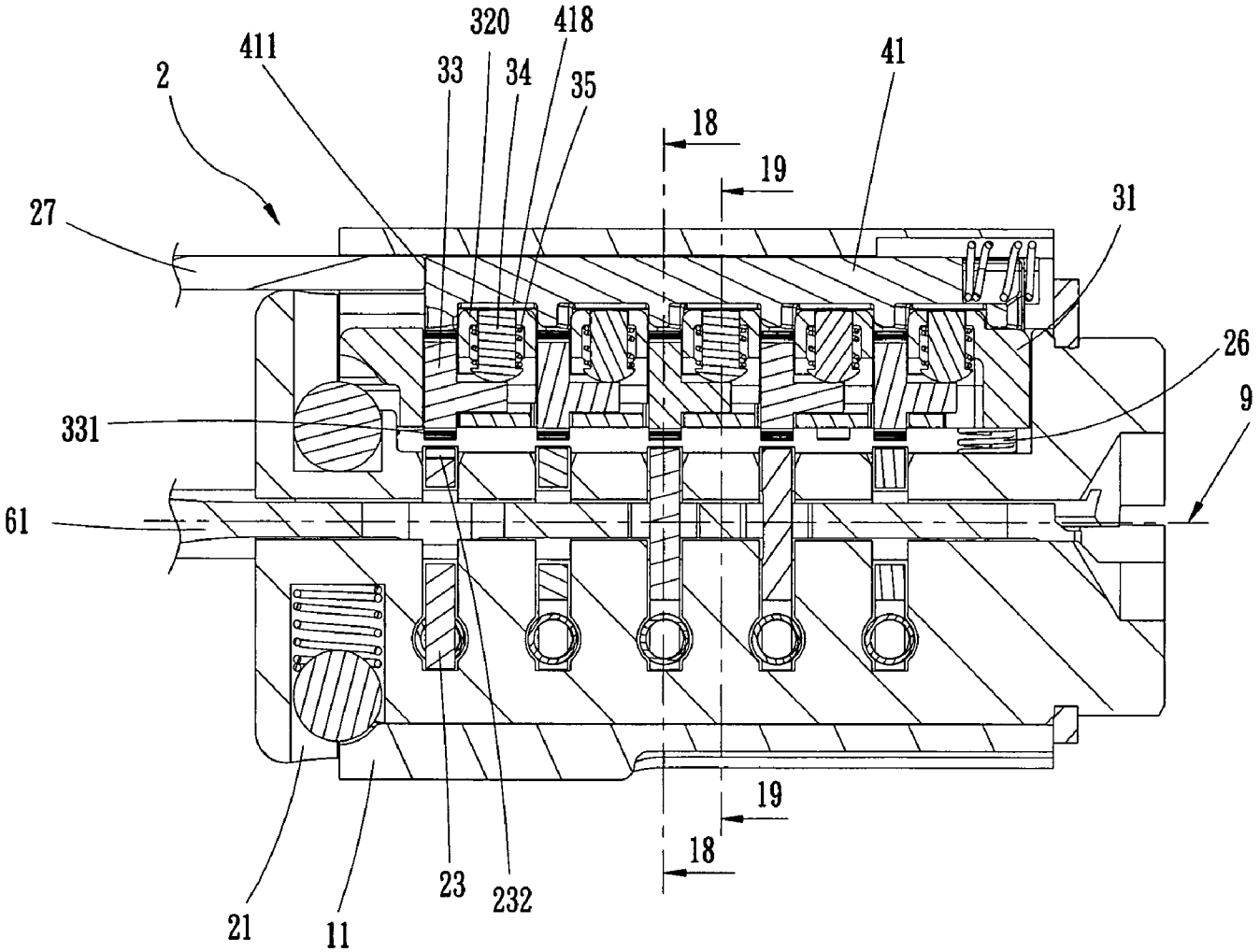
FIGS. 17-19 show that the control bar is moved by a tool.
Figure 19:
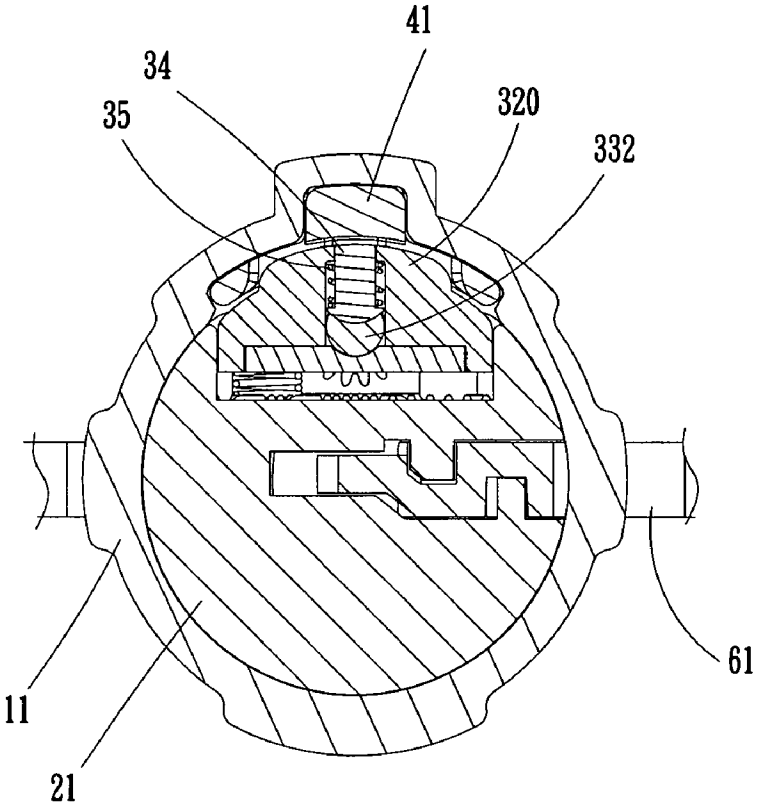
Figure 18:
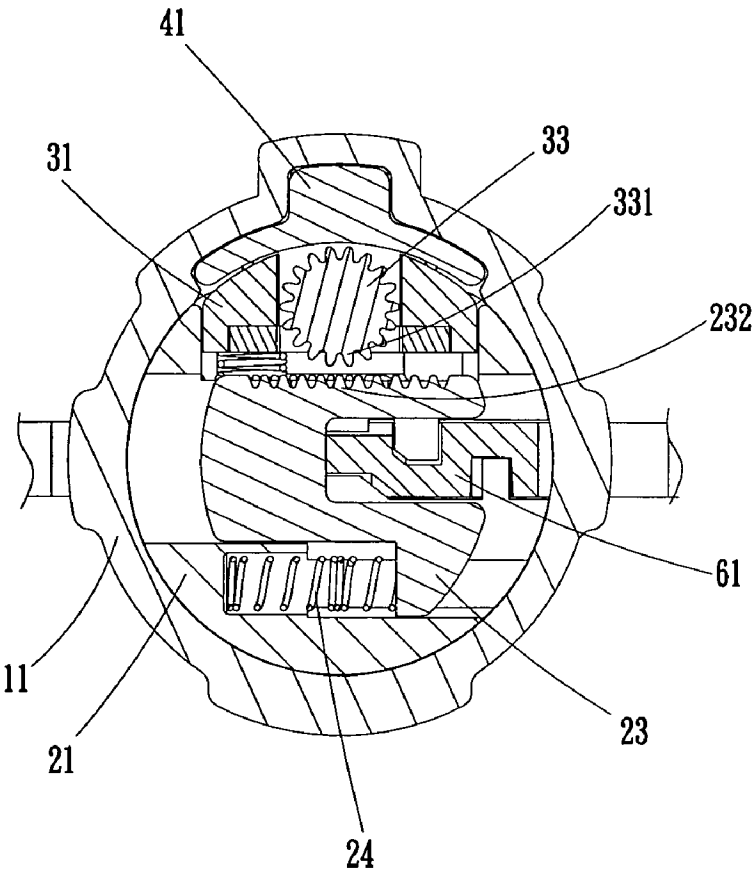

Referring to FIGS. 17-19, when a tool 27 is inserted into the lock housing 11 while the first key 61 is still in the plug 21 which is in its home position, the tool 27 pushes the front end of the spine portion 411 so that the control bar 41 is moved from a first position where the indentations 418 of the control bar 41 are not aligned with the respective protrusions 320 of the gear holder 31 (see FIGS. 11 and 14) to a second position where the indentations 418 are aligned with the respective protrusions 320 (FIG. 17). At this state, the protrusions 320 are permitted to extend into the respective indentations 418, and the gear holder 31 is permitted to move transversely of the longitudinal axis 9 via the action of the separation springs 26 in a direction away from the groove bottom face 217 of the plug 21. As a result, the gear wheels 33 disengage from the respective toothed parts 232 of the tumbler pieces 23, thereby permitting the re-keying of the tumbler pieces 23.

Figure 20:
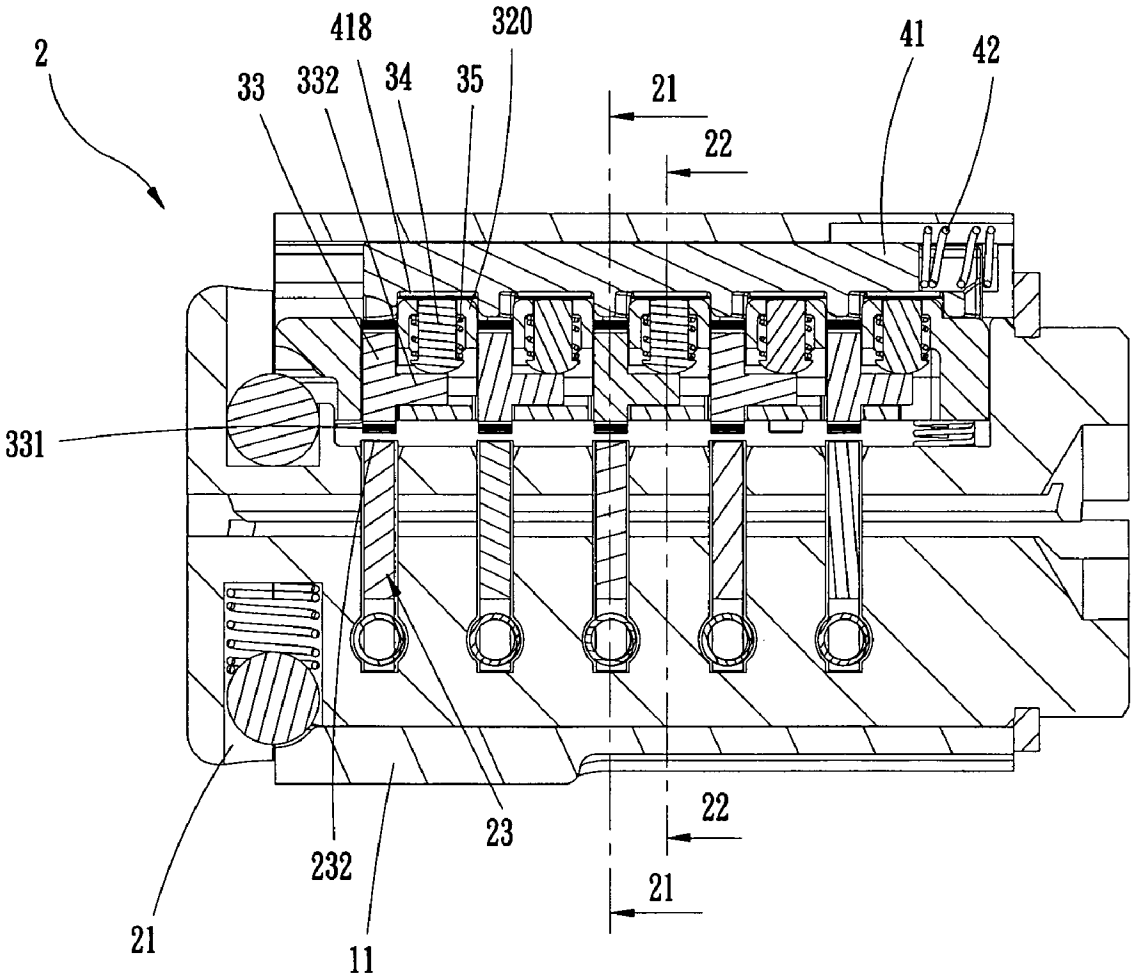
FIGS. 20-22 show that the first key is removed.
Figure 22:
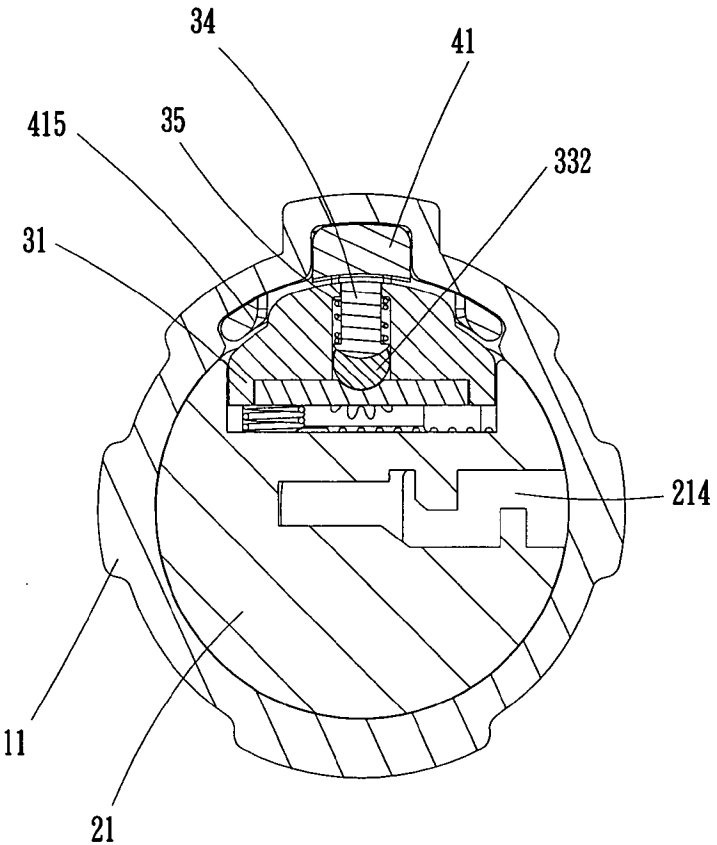
Figure 21:
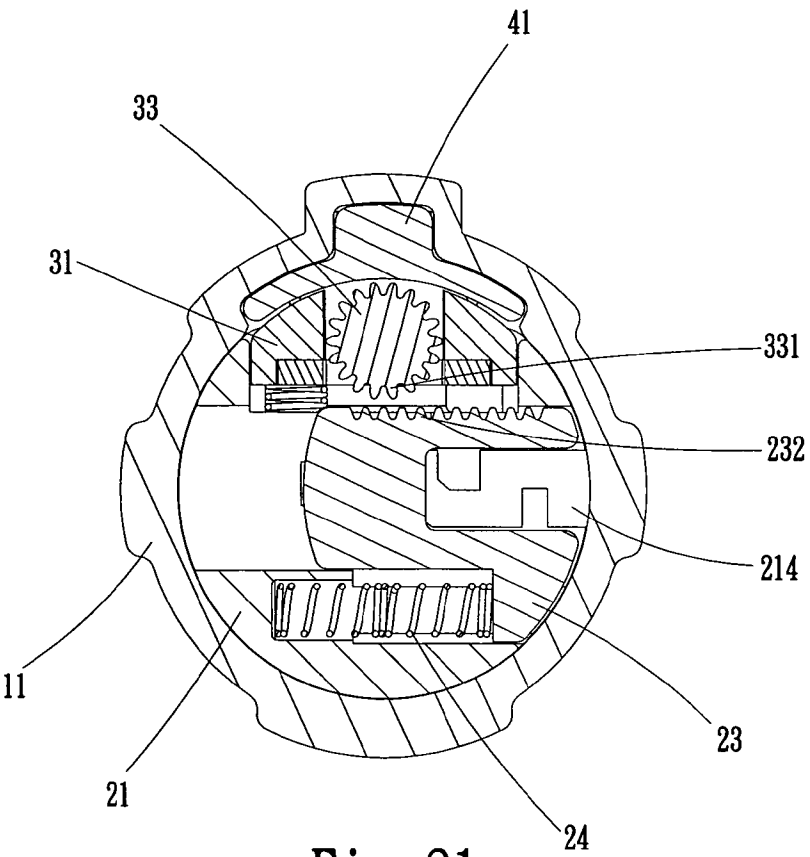
Figure 23:
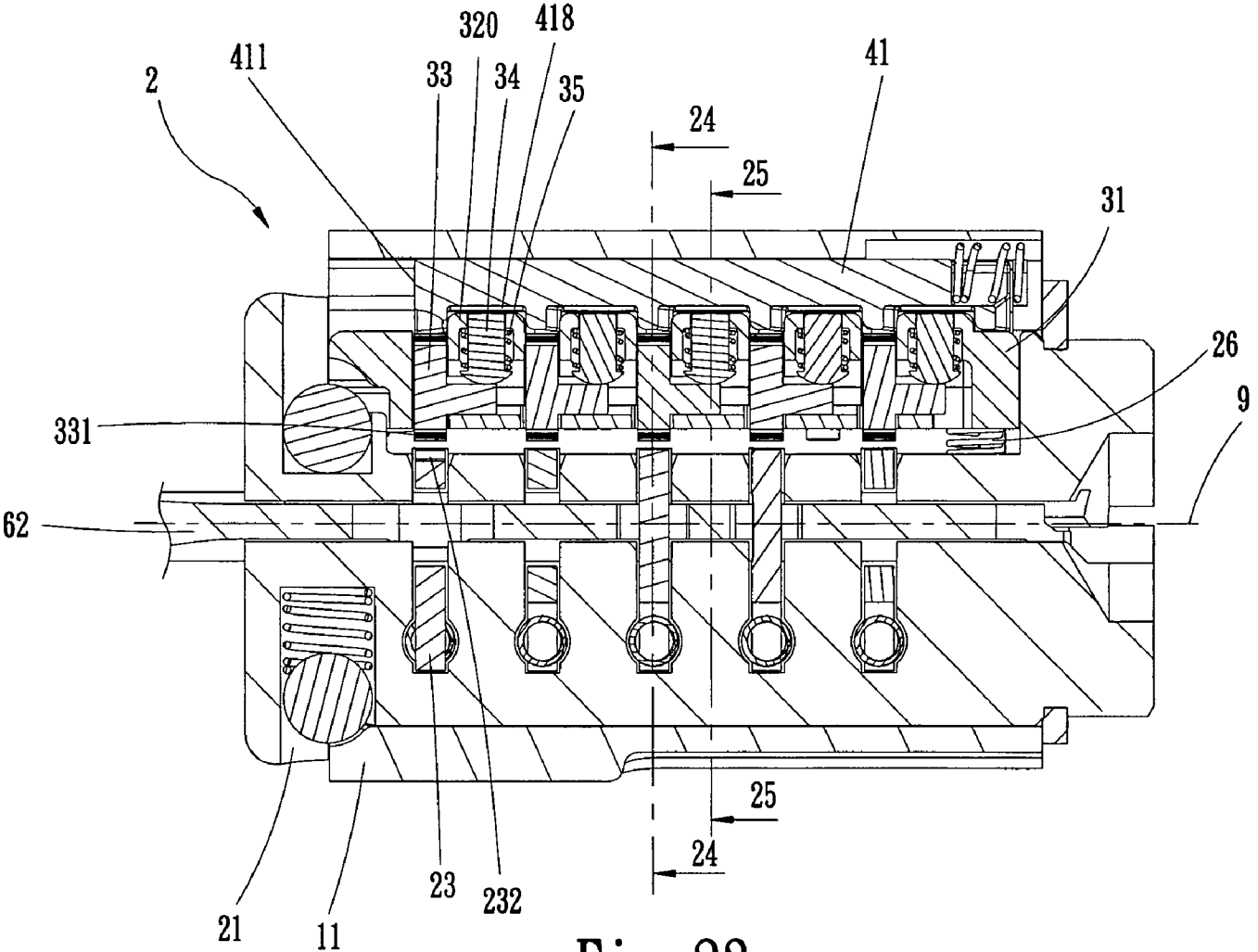
FIG. 23-25 show that a second key is inserted into the plug assembly.
Figure 25:
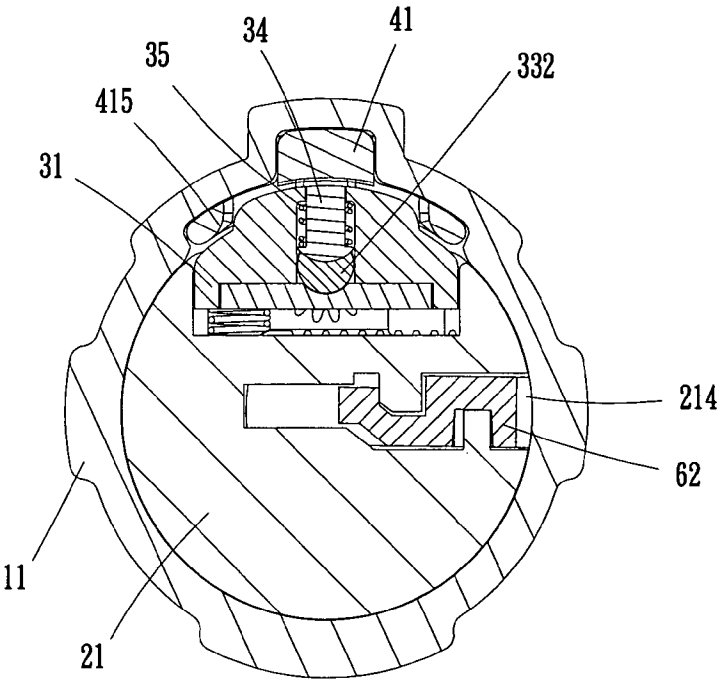
Figure 24:
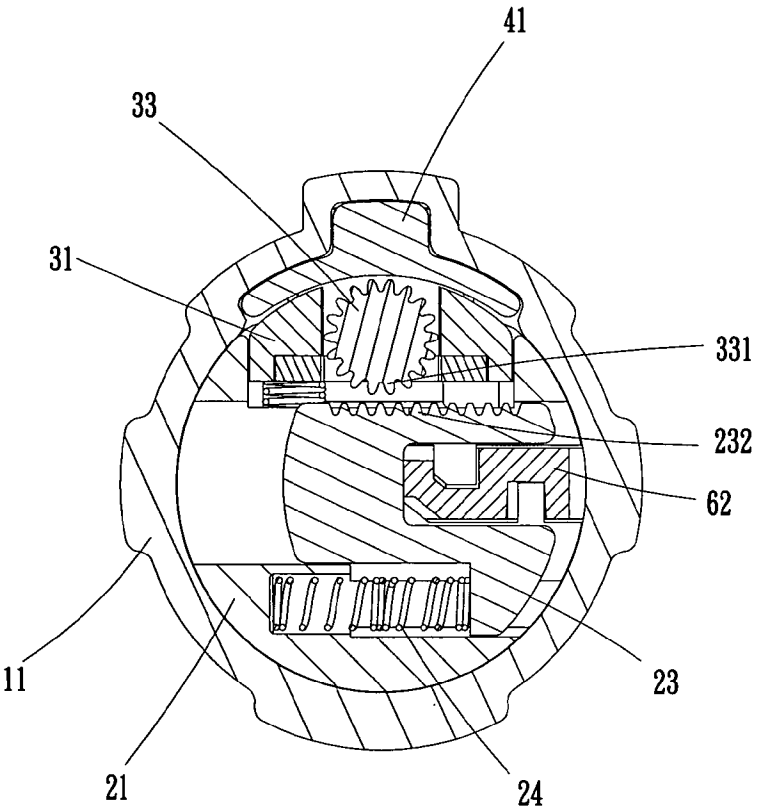
Figure 27:
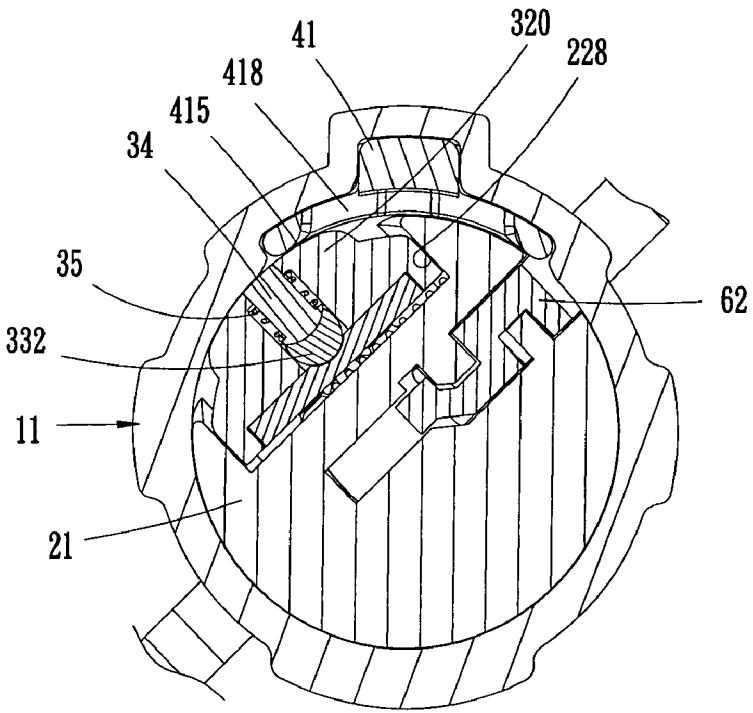
FIG. 26-27 show that the second key is turned to rotate the plug assembly.
Figure 26:
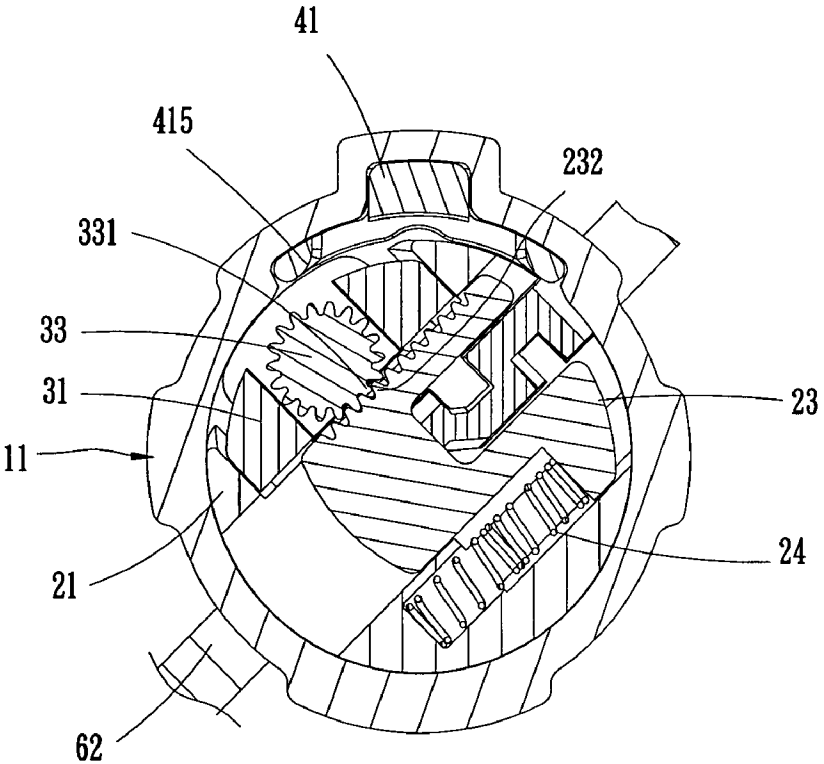

Referring to FIGS. 20-22, the tool 27 is removed from the lock housing 11 which is in its home position, and the first key 61 is removed from the plug 2 for re-keying the tumbler pieces 23 with a second key 62 which has a different profile from the first key 61. Referring to FIGS. 23-25, when the second key 62 is inserted, the tumbler pieces 23 are repositioned according to the different profile of the second key 62. When the second key 62 is rotated by a predetermined angle, as shown in FIGS. 26 and 27, the plug 21 is rotated together with the gear holder 31 to move away from the home position. Therefore, the gear holder 31 moves past the inclined face 415 of the control bar 41, and the protrusions 320 are pressed by the inclined face 415 to retract into the groove 228 of the plug 21, thereby re-engaging the gear wheels 33 with the toothed parts 232 of the tumbler pieces 23 and permitting the control bar 41 to return to its original position. At this state, the second key 62 can be rotated back to return the plug 21 to its home position.

Figure 28:
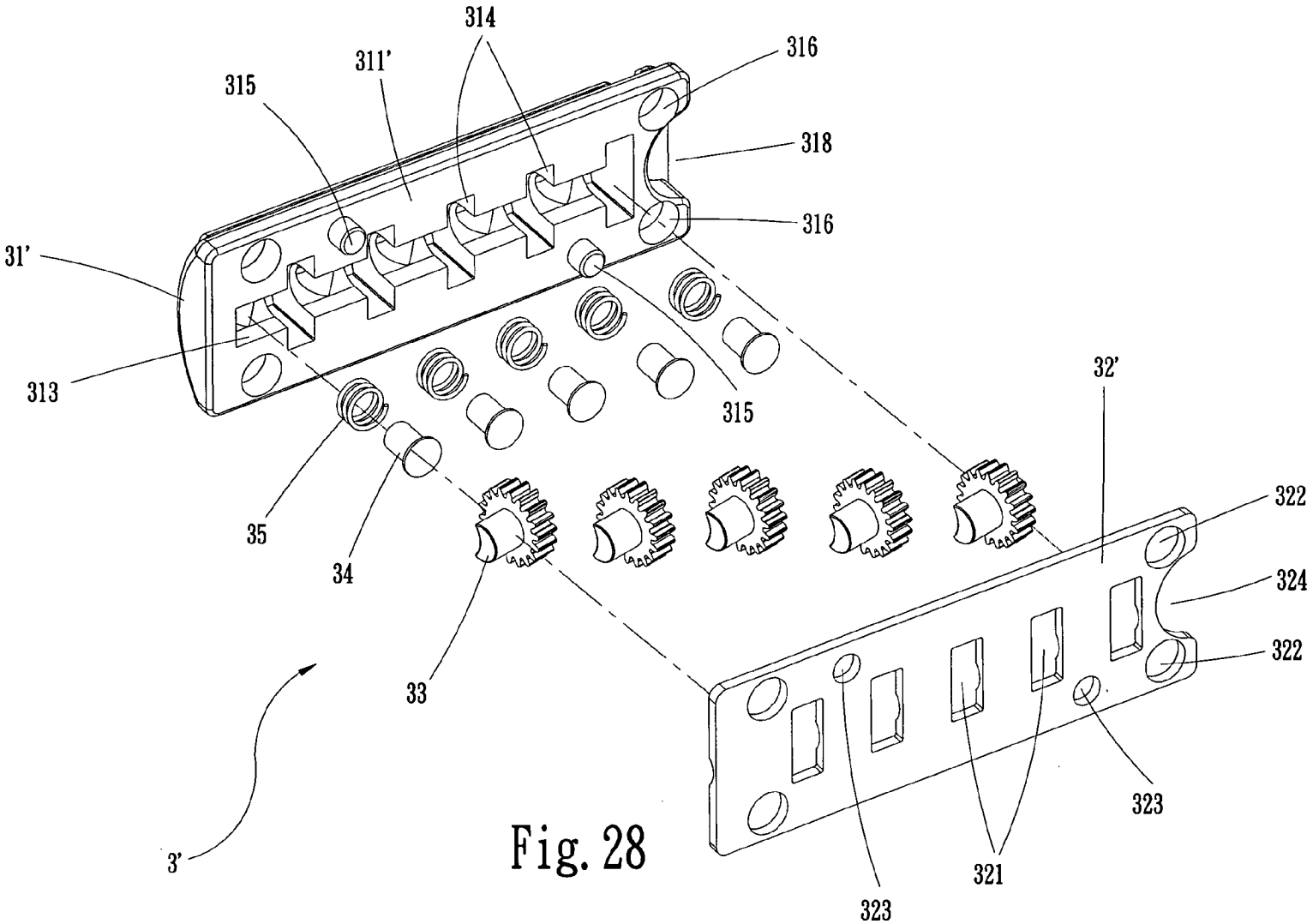
FIG. 28 shows an alternative configuration for the gear holder and the cover plate.

Referring to FIG. 28, an alternative form of the re-keying unit is shown at 3' in which the flat face 311' of the gear holder 31' does not have the recess 310 shown in FIG. 7, and the cover plate 32' has a semi-circular slot 324 in alignment with the semi-circular slot 318 to receive one of the anti-drilling balls 25, and spring holes 322 in alignment with the spring holes 316 to receive the separation springs 26. In this case, the number of the spring holes 322 or 316 is four.

Figure 29:
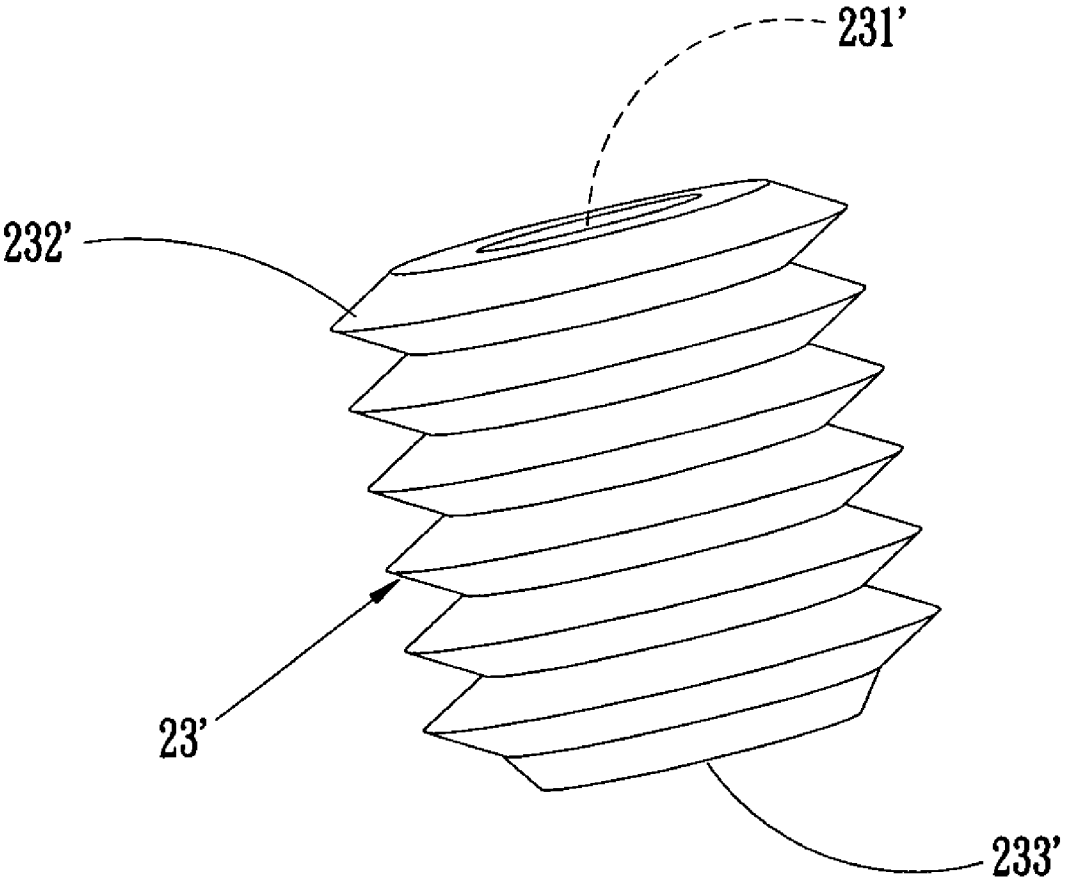
FIG. 29 shows another tumbler piece usable in the present invention.

Referring to FIG. 29, there is shown another tumbler piece 23' that may be used in place of the tumbler piece 23. The tumbler piece 23' has a spring-hole 231', a key-contacting part 233' and a toothed part 232'.

Figure 30:
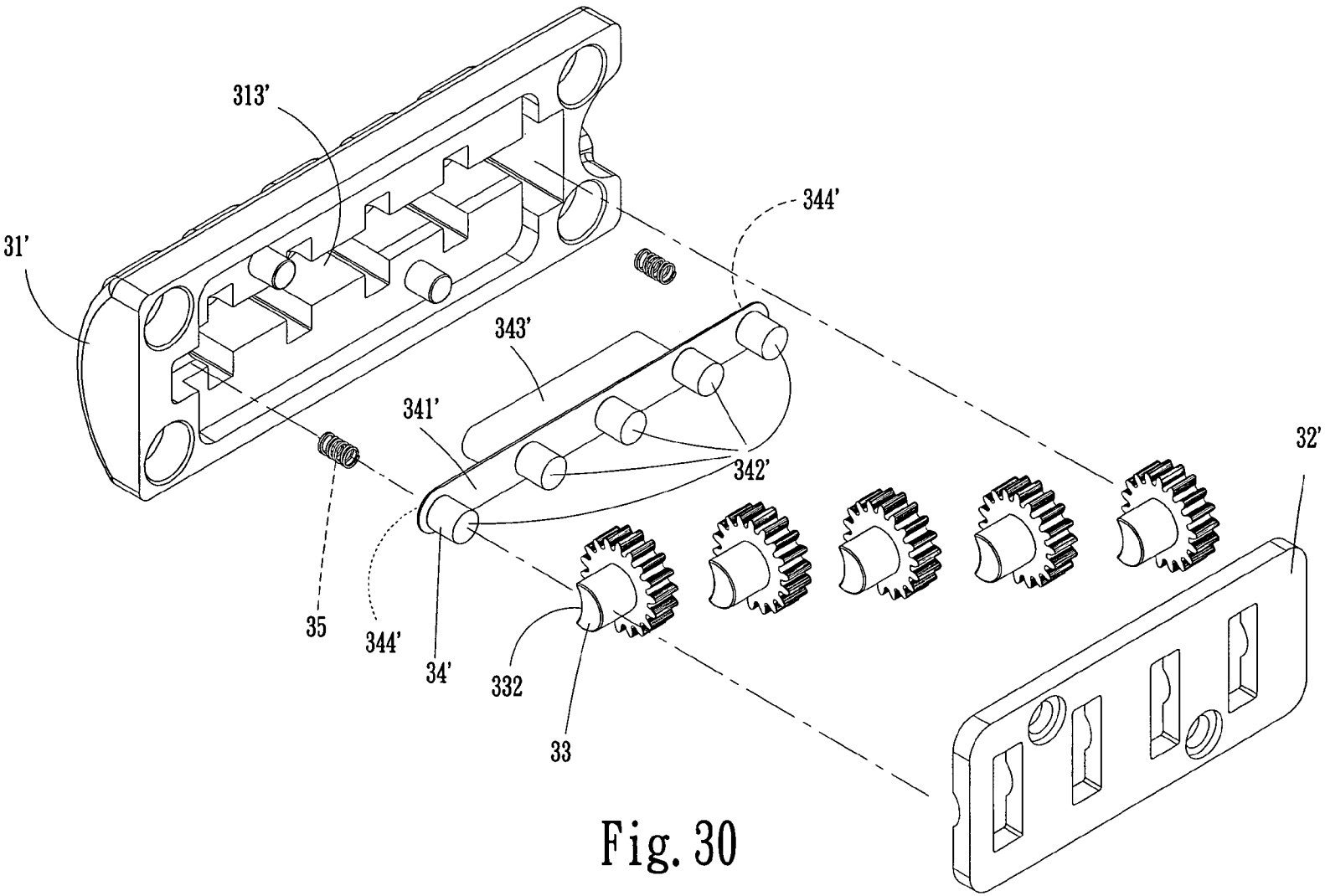
FIGS. 30-31 show an alternative configuration for a detent unit of the plug assembly.
Figure 31:
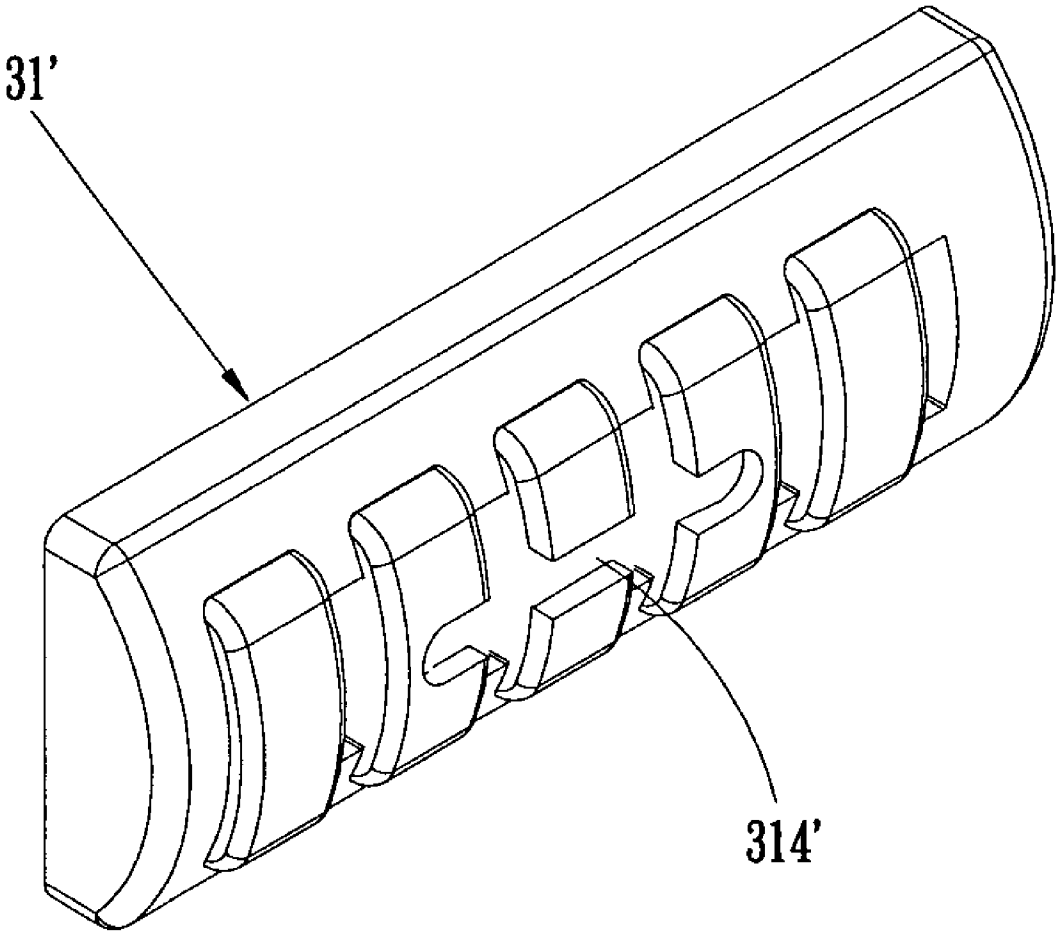

Referring to FIGS. 30 and 31, there is shown a unitary detent unit 34' that may be used in place of the detent elements 34. The detent unit 34' has a detent bar 341' disposed in the longitudinal slot 313' of the gear holder 31', a plurality of spaced apart detent elements 342' placed in contact with the respective cam portions 332 of the gear wheels 33 and interconnected by the detent bar 341', and a detent piece 343' projecting from the detent bar 341' oppositely of the detent elements 342'. Springs 35 are provided respectively in spring holes 344' which extend into two of the detent elements 342' through the detent bar 341'. The detent piece 343' is extendable through a hole 314' in the gear holder 31', which is communicated with the longitudinal slot 313'.

Figure 32:
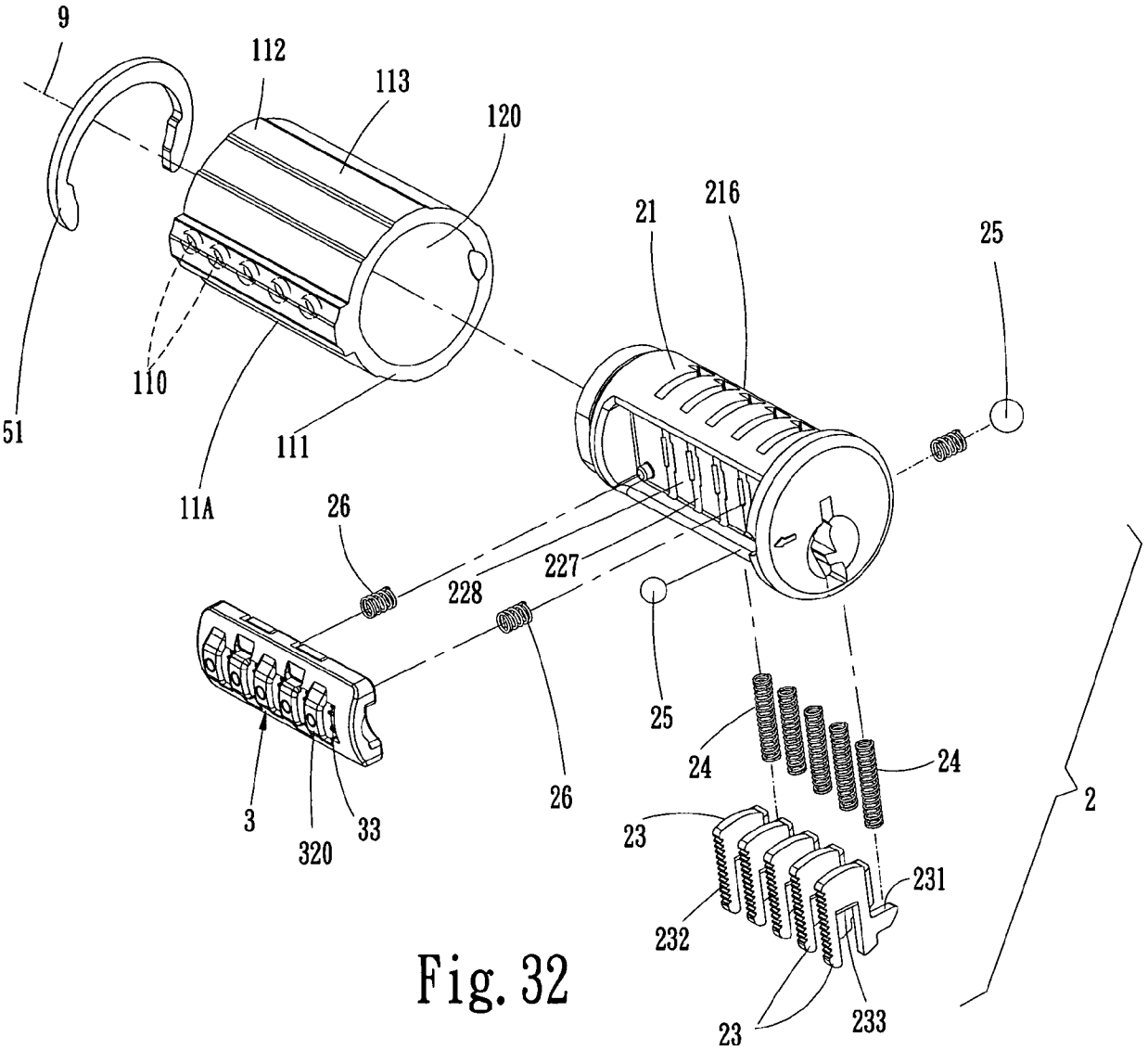
FIG. 32 shows a cylinder lock according to another preferred embodiment of the present invention.

Referring to FIG. 32, there is shown another preferred embodiment of the cylinder lock of the present invention in which the control bar 41 is not provided, and in which the lock housing 11A is not provided with the cavity 119 for receiving the control bar 41. The cylindrical wall 113 is slotted to form detent slots 110 for receiving the stems 341 of the detent elements 34 (see FIG. 7).

When it is necessary to re-key the cylinder lock of this embodiment, the plug assembly 2 may be disassembled from the lock housing 11A, and the re-keying unit 3 may be removed from the groove 228 of the plug 21 by moving the re-keying unit 3 transversely of the longitudinal axis of the lock housing 11A so as to disengage the gear wheels 33 from the respective tumbler pieces 23. Upon removal of the re-keying unit 3, a new key (not shown) may be inserted into the plug 21 to change the orientation of the tumbler pieces 23. When the re-keying unit 3 is re-inserted into the groove 28, the tumbler pieces 23 are re-positioned by the gear wheels 33.

Since the re-keying unit 3 is unitary and can be removed from the groove 228 or re-inserted thereinto as a whole, assembly and disassembly of the re-keying unit 3 is easy and convenient and may be done by the user without requiring professional skills.

Figure 33:
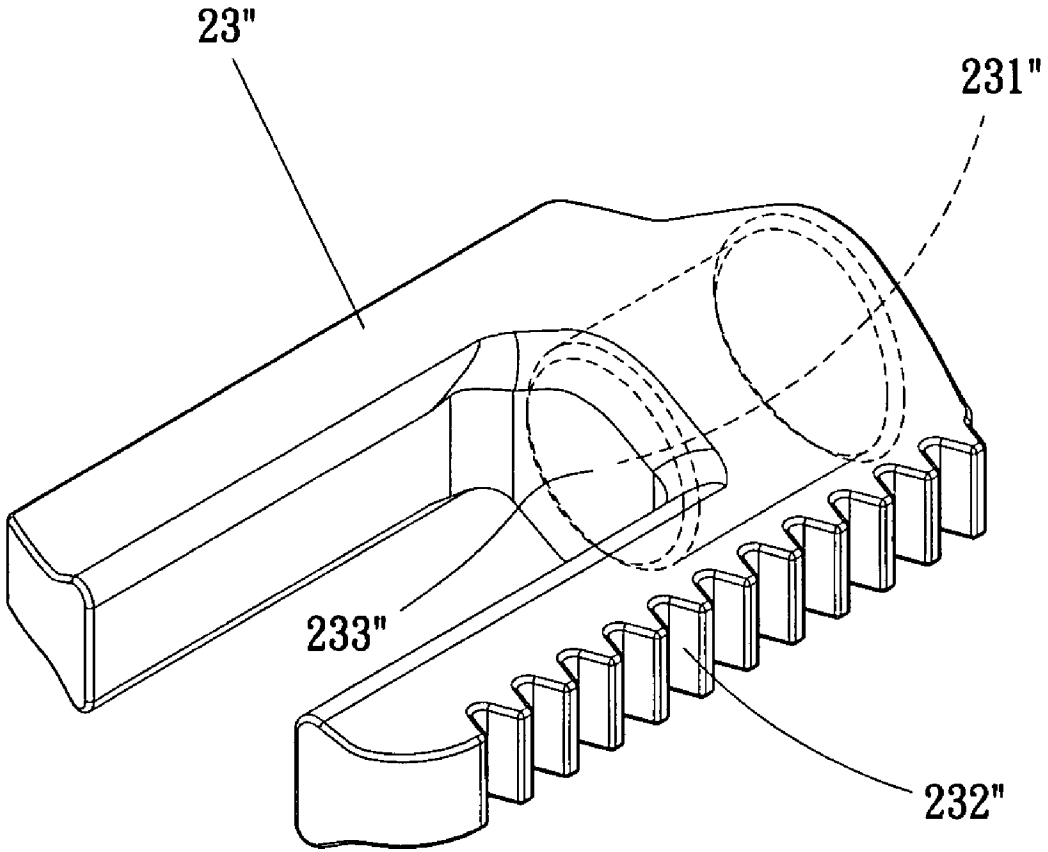
FIG. 33 shows still another tumbler piece usable in the present invention.

Referring to FIG. 33, there is shown still another tumbler piece 23" that may be used in the present invention The tumbler piece 23" has a spring-hole 231", a key-contacting part 233" and a toothed part 232".

Figure 34:
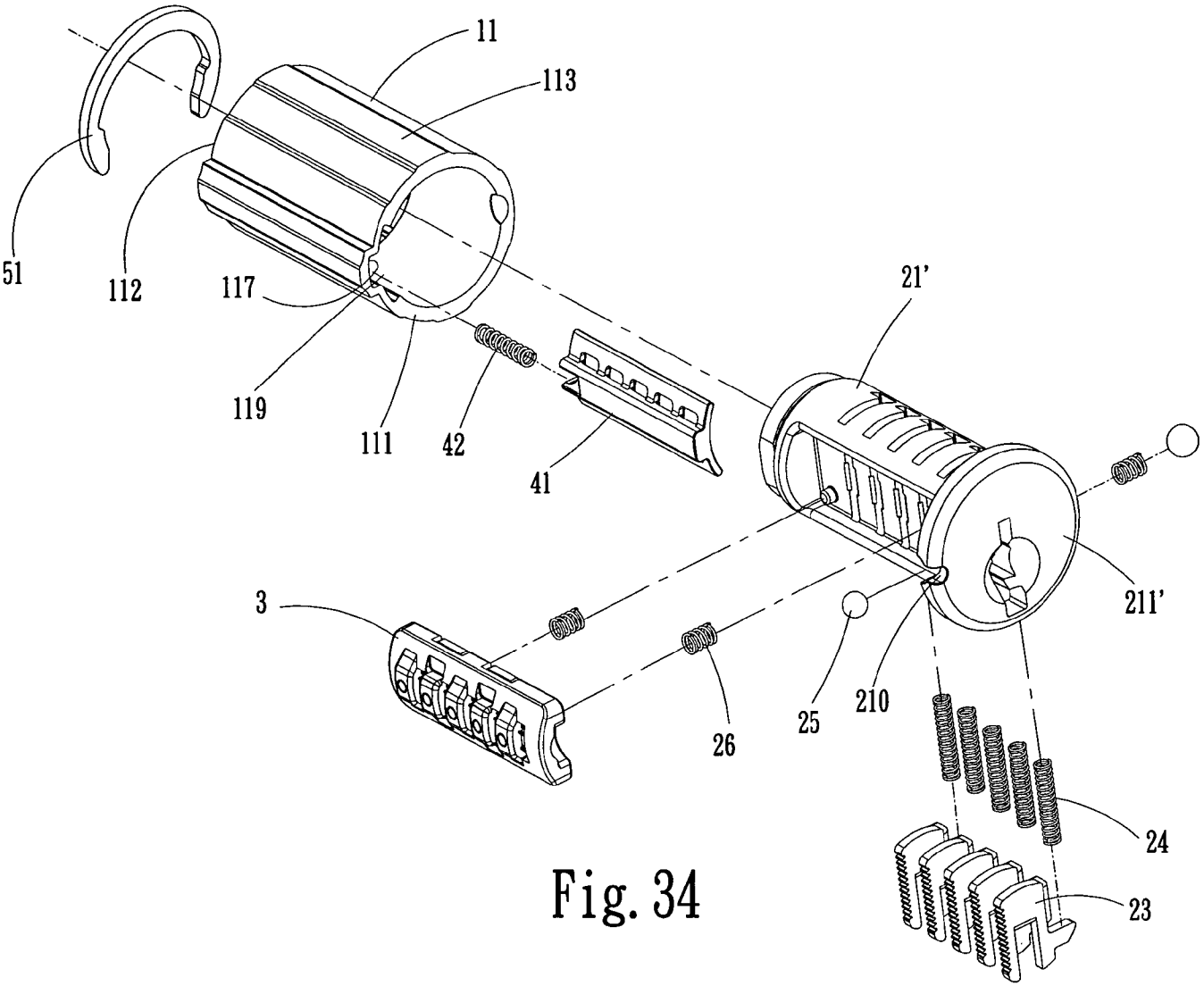
FIG. 34 shows a re-keyable cylinder lock according to still another preferred embodiment of the present invention.

Referring to FIG. 34, there is shown still another embodiment of the cylinder lock of the present invention in which the plug section 211" of the plug 21" is enlarged compared to the plug section 211 of the plug 21 in the previous embodiments.

The plug section 211" has a notch 210 so that the tool 27 (FIG. 17) may be inserted into the cavity 119 through the notch 210.

Figure 35:
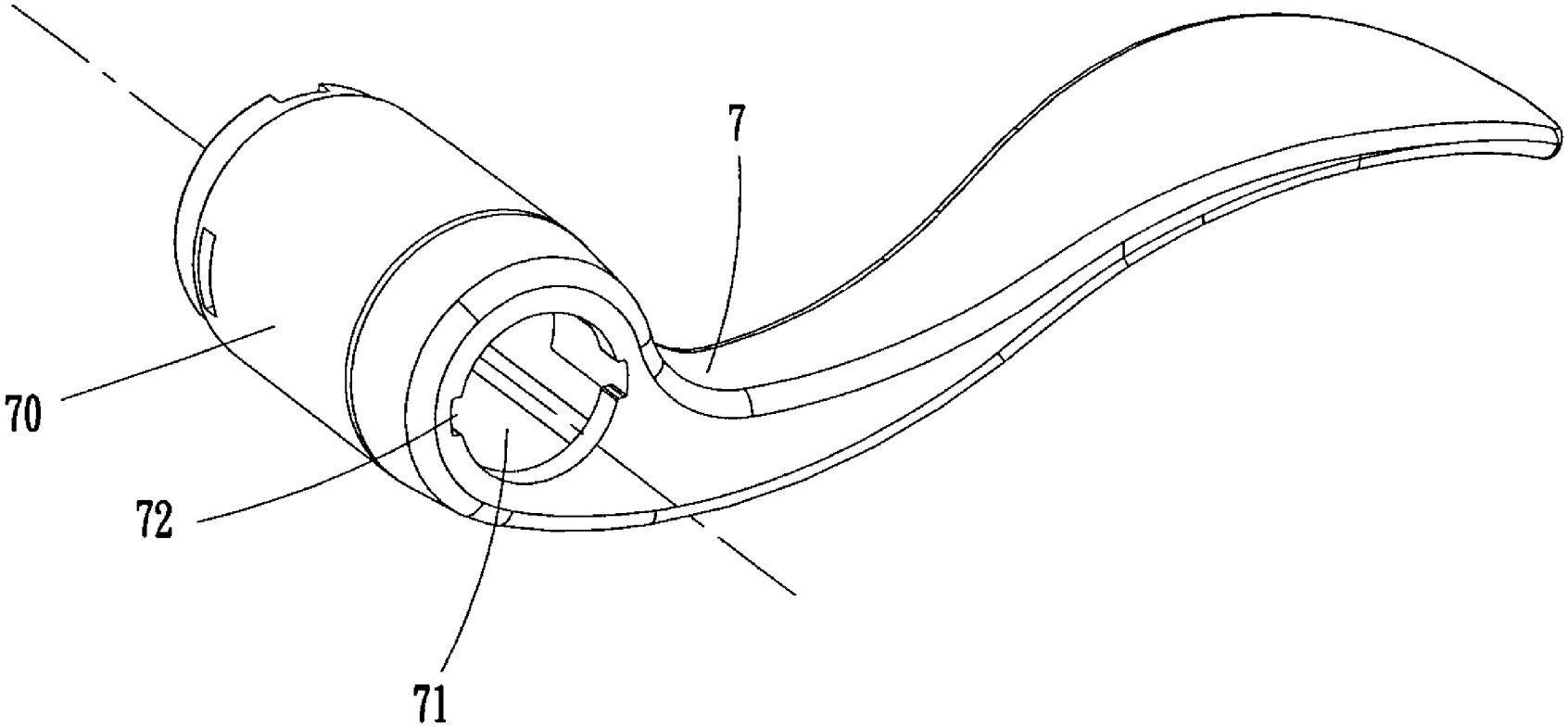
FIG. 35 shows a handle that may be used in combination with the re-keyable cylinder lock of the present invention.

Referring to FIG. 35, there is shown a lever handle 7 having a hollow body 70 formed with a lock hole 71 and two notches 72. In use, the lock housing 11 may be placed in the lock hole 71, and the tool 27 (FIG. 17) may be inserted through one of the notches 72. Such notches 72 may also be provided in a handle knob, or in a panel or frame on which the cylinder lock is to be installed.

Referring back to FIGS. 2 and 2*a* in combination with FIG. 35, the hollow body 70 of the lever handle 7 may be designed to have the axial plug hole 120 and the cavity 119 of the lock housing 11. In this case, the lock housing 11 may be dispensed with, and the plug assembly 2 may be inserted directly into the hollow body 70.

Figure 36:
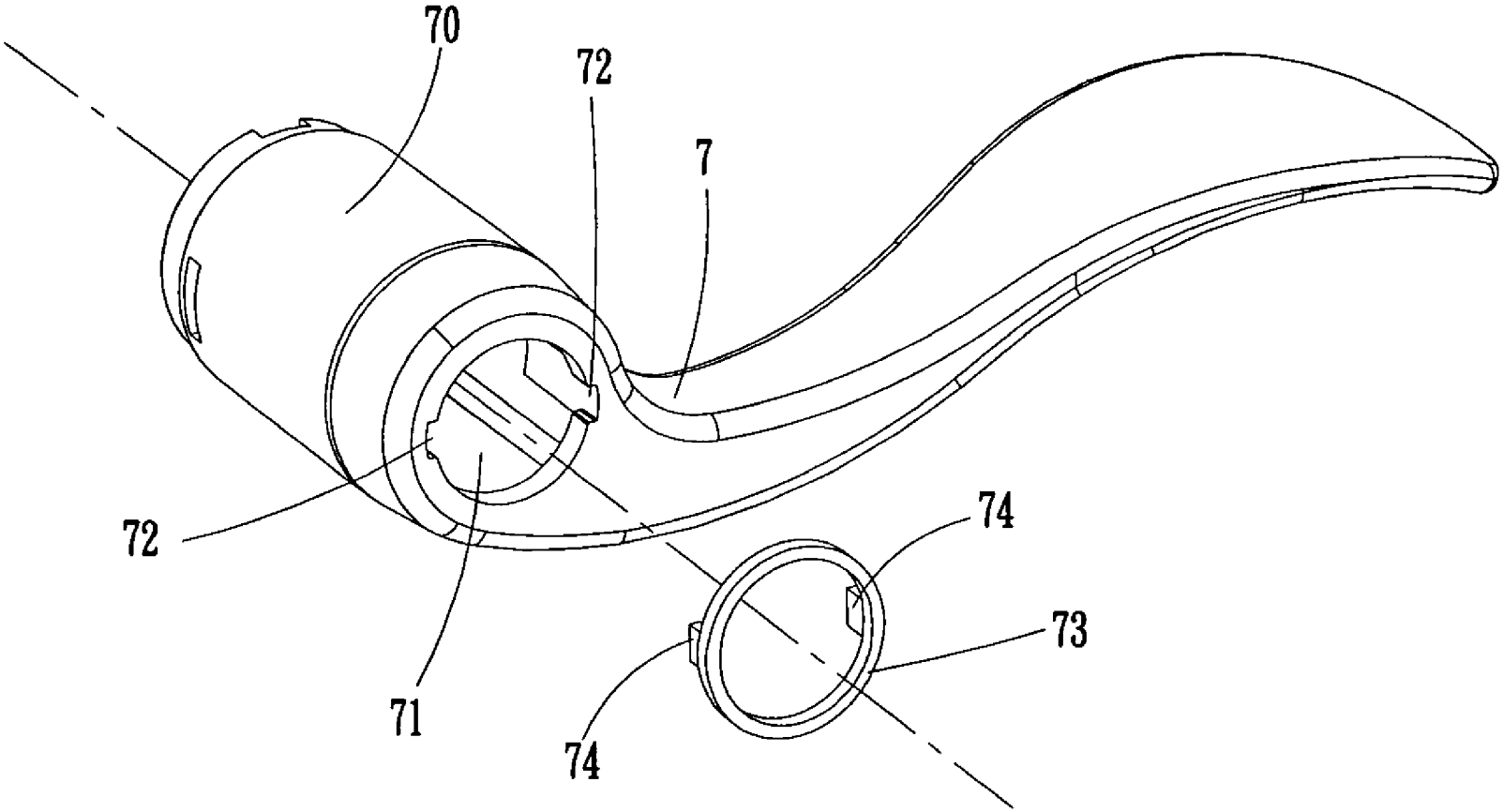
FIG. 36 shows a covering ring and a handle that may be used in combination with the re-keyable cylinder lock.

Referring to FIG. 36, the lever handle 7 is provided with a pair of the notches 72, and a covering ring 73 is provided to cover the notches 72. In particular, the covering ring 73 has a pair of legs 74 that can be fitted respectively in the notches 72. In case the tool 27 (FIG. 17) is to be inserted into one of the notches 72, the legs 74 may be disengaged from the respective notches 72 to remove the covering ring 73.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

We claim:

1. A re-keyable cylinder lock comprising:

a plug including a key hole, and a plurality of tumbler pieces each having toothed parts, the tumbler pieces being movable in a direction transverse to a longitudinal axis of the plug when a key is inserted into the key hole; and a re-keying unit that has a plurality of gear wheels each of which is engaged with one of the toothed parts, each of the gear wheels being rotatable by a respective one of the tumbler pieces about an axis of rotation substantially parallel to the longitudinal axis of the plug when the key is inserted into the key hole, wherein each of the gear wheels disengages from a respective one of the toothed parts when moving transversely of the longitudinal axis in a direction away from the toothed parts and substantially perpendicular to the direction that the tumbler pieces move.

2. The re-keyable cylinder lock of claim 1, further comprising a lock housing having a plug hole, said plug being rotatably disposed within said plug hole.

3. The re-keyable cylinder lock of claim 2, further comprising a control bar that is disposed in said lock housing, is movable substantially parallel to the longitudinal axis, and permits or prevents movement of said gear wheels in a direction transverse to said longitudinal axis.

4. The re-keyable cylinder lock of claim 3, wherein said control bar has an indentation, said re-keying unit further having a gear holder holding said gear wheels, said gear holder being disposed in said plug and being extendable into said indentation to permit said gear wheels to move away from said tumbler pieces.

5. The re-keyable cylinder lock of claim 4, wherein said plug has an outer surface that is recessed to form a groove to receive said gear holder, said gear holder including a protrusion that has a curved outer surface substantially flush with said outer surface when said gear wheels engage said tumbler pieces, respectively, said protrusion projecting from said outer surface and extending into said indentation when said gear wheels move away from said tumbler pieces.

6. The re-keyable cylinder lock of claim 5, wherein said control bar is movable between a first position in which said indentation is not aligned with said protrusion, and a second position in which said protrusion is aligned with said indentation.

7. The re-keyable cylinder lock of claim 5, wherein said lock housing further has a cavity in juxtaposition to said plug hole, said control bar being movably received in said cavity.

8. The re-keyable cylinder lock of claim 1, wherein said re-keying unit further has a gear holder holding said gear wheels, said gear holder being rotatable along with said plug and being movable relative to said plug transversely of said longitudinal axis.

9. The re-keyable cylinder lock of claim 8, further comprising a separation spring disposed between said plug and said gear holder to bias said gear holder to move transversely of said longitudinal axis.

10. A cylinder lock comprising:

a lock housing having a plug hole with a longitudinal axis;

a plug disposed rotatably within said plug hole and including a tumbler piece having a toothed part; and a re-keying unit that has a gear wheel engaged releasably with said toothed part to reposition said tumbler piece, said gear wheel being rotatable about an axis substantially parallel to said longitudinal axis when a key is inserted into the plug, the gear wheel being movable in a direction transverse to the longitudinal axis to disengage from the toothed part, the gear wheel having an integral cam portion rotatable along with the gear wheel; and a detent element that is disposed in the plug, that is cammed by the cam portion to project substantially radially from the plug to limit rotation of the plug relative to the lock housing, and that is normally biased to retract inwardly of the plug to permit rotation of the plug.

11. The cylinder lock of claim 10, wherein said cam portion projects axially from said gear wheel.

12. The cylinder lock of claim 10, wherein said re-keying unit further has a gear holder that is disposed in said plug, that is movable transversely of said longitudinal axis and holds said gear wheel and said detent element, said lock housing further having a longitudinally extending cavity in juxtaposition to said plug, said cavity receiving a control bar that is movable between a first position that prevents the gear holder from moving transversely in a direction away from the plug to thereby limit disengagement of the gear wheel from the tumbler piece, and a second position that permits the gear holder to move transversely to thereby allow disengagement of the gear wheel from the tumbler piece.

13. The cylinder lock of claim 12, wherein said cavity has first and second cavity sections receiving said control bar, said second cavity section being disposed between and communicated with said first cavity section and said plug hole, said first cavity section being smaller in width than said second cavity section.

14. The cylinder lock of claim 12, wherein said control bar has an indentation and a detent slot, said detent element being extendable into said detent slot, said gear holder further having a protrusion extendable into said indentation.

15. The cylinder lock of claim 14, wherein said protrusion has a hole, and said detent element is extendable through said hole of said protrusion to project into said detent slot.

16. The cylinder lock of claim 10, wherein said detent element has ahead, and a stem connected to said head, said cam portion contacting said head.

17. A method of re-keying a cylinder lock, comprising:

providing the cylinder lock with a plug that has a tumbler piece with a toothed part, and a re-keying unit that has a gear wheel to releasably engage the toothed part of the tumbler piece;

providing a control bar in juxtaposition to the plug;

disposing in the plug a detent element that projects from the plug into the control bar to limit movement of the control bar and to limit rotation of the plug when the plug is in a home position;

inserting a first key into the plug to cause the detent element to retract into the plug while the plug is in its home position; and moving the control bar from a first position to a second position while the plug is still in the home position and while the detent element is retracting from the control bar; and moving the gear wheel transversely of the longitudinal axis of the plug to disengage from the tumbler piece while the plug is still in the home position, and while the control bar is in the second position.

18. The method of claim 17, further comprising:

removing the first key from the plug while the plug is still in the home position;

inserting a second key into the plug to reposition the tumbler piece relative to the re-keying unit while the plug is still in the home position, the second key being different from the first key; and rotating the plug away from the home position by turning the second key for returning the re-keying unit to the tumbler piece to re-engage the gear wheel with the tumbler piece and for returning the control bar to the first position.

19. The method of claim 18, further comprising providing a detent slot in the control bar, and receiving the detent element in the detent slot when the detent element projects.

20. The method of claim 18, further comprising rotating back the second key to return the plug to the home position.

21. The method of claim 18, wherein the gear wheel has an axis of rotation substantially parallel to the longitudinal axis.

22. A method of re-keying a cylinder lock, comprising:

providing the cylinder lock with a lock housing which receives a plug that has a tumbler piece, and a re-keying unit that has a gear wheel;

receiving a gear holder in the plug to hold the gear wheel;

providing a detent element in the plug that is normally biased to project from the plug to limit rotation of the plug;

inserting a first key into the plug to cause the detent element to retract into the plug;

biasing the gear holder to move transversely of the longitudinal axis of the plug and in the direction away from the plug;

disposing a control bar within the lock housing in juxtaposition to the plug and placing the control bar in a first position to prevent the gear holder to move in the direction away from the plug;

moving the control bar from a first position to a second position that permits the gear holder to move in the direction away from the plug; and causing the gear wheel to move away from the tumbler piece when the gear holder is permitted to move in the direction away from the plug.

23. The method of claim 11, further comprising:

removing the first key from the plug;

inserting a second key into the plug to reposition the tumbler piece relative to the gear wheel, the second key being different from the first key; and permitting the re-keying unit to return to the tumbler piece by turning the second key to rotate the plug so that the gear-wheel re-engages the tumbler piece.

24. The method of claim 22, wherein, when the first key is inserted into the plug, the gear wheel can be rotated about an axis substantially parallel to the longitudinal axis.

25. The method of claim 22, wherein the lock housing has a plug hole receiving the plug and the re-keying unit, and a cavity that receives the control bar and that is disposed in juxtaposition to the plug hole.

26. A method of re-keying a cylinder lock, comprising:

providing the cylinder lock with a plug that has a tumbler piece, and a re-keying unit that has a gear wheel engaging the tumbler piece;

providing a control bar in juxtaposition to the plug;

biasing a detent element to retract inwardly of the plug and to thereby permit rotation of the plug;

pushing the detent element to project outwardly of the plug and to thereby limit rotating of the plug by using a cam portion;

inserting a first key into the plug to move the tumbler piece;

causing the tumbler piece to rotate the gear wheel;

causing the gear wheel to operate the cam portion and to thereby permit the detent element to retract inwardly of the plug moving the control bar from a first position to a second position when the detent element retracts;

moving the gear wheel to disengage from the tumbler piece when the control bar is in the second position;

removing the first key from the plug when the control bar is in the second position; and inserting a second key into the plug to reposition the tumbler piece relative to the gear wheel.

27. A re-keyable cylinder lock comprising:

a lock housing defining a plug hole and a cavity in juxtaposition to the plug hole;

a plug rotatably disposed within the plug hole, the plug including a key hole, a plurality of tumbler pieces each having a toothed part, and an outer surface that is recessed to form a groove;

a gear holder disposed in the groove of the plug, and being biased to move in a direction transverse to a longitudinal axis of the plug and to project from the groove to the cavity;

a plurality of gear wheels disposed in the gear holder to re-key the tumbler pieces, the gear wheels engaging respectively the toothed parts of the tumbler pieces when the gear holder does not project from the groove, and disengaging respectively from the tumbler pieces when the gear holder projects from the groove; and a control bar disposed in the cavity, the control bar being operable to move between a first position that prevents the gear holder from projecting into the cavity, and a second position that permits the gear holder to project into the cavity.

28. The re-keyable cylinder lock of claim 27, further comprising a plurality of detent elements and cam portions all of which are disposed in the gear holder, each of the gear wheels being rotated about an axis substantially parallel to the longitudinal axis when a key is inserted into the key hole of the plug, each of the cam portions being connected to and moved by one of the gear wheels to cam one of the detent elements to thereby limit the lug from rotation and the control bar from movement.

29. The re-keyable cylinder lock of claim 28, wherein each of the cam portions projects axially from a central part of a respective one of the gear wheels, and is in contact with a respective one of the detent elements.

30. The re-keyable cylinder lock of claim 28, wherein the control bar has a plurality of detent slots, each of the detent elements being extendable into on of the detent slots to limit rotation of the plug and movement of the control bar.

31. A re-keyable cylinder lock comprising:

A lock housing defining a plug hole, and a cavity in juxtaposition to the plug hole;

A plug disposed rotatably within the plug hole, the plug including a key hole, a tumbler piece having a toothed part, and an outer surface that is recessed to form a groove;

A gear holder disposed in the groove of the plug, and being biased to move in a direction transverse to a longitudinal axis of the plug for projecting from the groove to the cavity;

A gear wheel disposed in the gear holder to re-key the tumbler piece, the gear wheel being engaged releaseably with the toothed part of the tumbler piece, the gear wheel being rotated about an axis substantially parallel to the longitudinal axis when a key is inserted into the key hold of the plug;

a control bar disposed slidably in the cavity and having a detent slot, the control bar being operable to move between a first position that prevents the gear holder from projecting into the cavity, and a second position that permits the gear holder to project into the cavity; and a detent element and a cam portion all of which are disposed in the gear holder, the cam portion being moved by the gear wheel to cam the detent element, the detent element being extendable from the gear holder into the detent slot to thereby limit the pug from rotation and the control bar from movement.

32. A re-keyable cylinder lock comprising:

A lock housing defining a plug hole, and a cavity in juxtaposition to the plug hole;

A plug disposed within the plug hole and movable between a non-rotatable locking position and a rotatable unlocking position, the plug having a tumbler piece with a toothed part;

A gear holder disposed in the plug and substantially aligned with the cavity when the plug is in the non-rotatable locking position, the gear holder being biased to project into the cavity;

A gear wheel disposed in the gear holder to re-key the tumbler piece, the gear wheel being engaged releaseably with the toothed part of the tumbler piece, the gear wheel being rotated about an axis substantially parallel to the longitudinal axis when a key is inserted into the key hole of the plug;

A control bar disposed slidably in the cavity and having a detent slot, the control bar being operable to move between a first position that prevents the gear holder from projecting into the cavity, and a second position that permits the gear holder to project into the cavity; and A detent element and a cam portion all of which are disposed in the gear holder, the cam portion being rotatable along with the gear wheel and contacting the detent element, the detent element being moved by the cam portion to extend from the gear holder into the detent slot to thereby limit the plug from rotation and the control bar from movement.

* * * * *